US011808270B2

(12) United States Patent
Teramoto et al.

(10) Patent No.: US 11,808,270 B2
(45) Date of Patent: Nov. 7, 2023

(54) IMPELLER, MULTI-BLADE AIR-SENDING DEVICE, AND AIR-CONDITIONING APPARATUS

(71) Applicant: Mitsubishi Electric Corporation, Tokyo (JP)

(72) Inventors: Takuya Teramoto, Tokyo (JP); Hiroyasu Hayashi, Tokyo (JP); Ryo Horie, Tokyo (JP); Kazuya Michikami, Tokyo (JP); Takahiro Yamatani, Tokyo (JP); Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 103 days.

(21) Appl. No.: 17/438,553

(22) PCT Filed: Apr. 25, 2019

(86) PCT No.: PCT/JP2019/017548
§ 371 (c)(1),
(2) Date: Sep. 13, 2021

(87) PCT Pub. No.: WO2020/217367
PCT Pub. Date: Oct. 29, 2020

(65) Prior Publication Data

US 2022/0145893 A1 May 12, 2022

(51) Int. Cl.
*F04D 17/16* (2006.01)
*F04D 29/28* (2006.01)
(Continued)

(52) U.S. Cl.
CPC ..... *F04D 17/162* (2013.01); *F04D 29/282* (2013.01); *F04D 29/30* (2013.01);
(Continued)

(58) Field of Classification Search
CPC .... F04D 17/162; F04D 29/281; F04D 29/282; F04D 29/30; F04D 29/4213; F04D 29/424
See application file for complete search history.

(56) References Cited

U.S. PATENT DOCUMENTS 7,186,080 B2 * 3/2007 Smiley, III ..... F04D 29/4226 415/206
2012/0269621 A1 10/2012 Shirahama
2016/0153457 A1 6/2016 Jang et al.

FOREIGN PATENT DOCUMENTS

CN 101313153 A 11/2008
EP 0 381 758 A1 8/1990
(Continued)

OTHER PUBLICATIONS

Translation of EP0381758 (Year: 1990).*
(Continued)

*Primary Examiner* — Brian O Peters
(74) *Attorney, Agent, or Firm* — POSZ LAW GROUP, PLC

(57) ABSTRACT

An impeller includes a backing plate, a rim disposed so as to face the backing plate, and a plurality of blades arranged in a circumferential direction around a virtual rotation axis of the backing plate. Each of the plurality of blades has an inner circumferential end, an outer circumferential end a sirocco blade portion being forward-swept and including the outer circumferential end and having a blade outlet angle of larger than 90 degrees, and a turbo blade portion being swept-back and including the inner circumferential end, a first region located closer to the backing plate than a middle point in an axial direction of the rotation axis, and a second region located closer to the rim than the first region. Each of the plurality of blades is formed such that a blade length in the first region is longer than a blade length in the second
(Continued)

region. In the first region and the second region, a ratio of the turbo blade portion in the radial direction is larger than a ratio of the sirocco blade portion in the radial direction.

18 Claims, 16 Drawing Sheets

(51) Int. Cl.

| | |
|---|---|
| ***F04D 29/30*** | (2006.01) |
| ***F04D 29/42*** | (2006.01) |
| ***F04D 29/44*** | (2006.01) |
| ***F04D 29/60*** | (2006.01) |
| ***F04D 29/68*** | (2006.01) |

(52) U.S. Cl.
CPC ..... *F04D 29/424* (2013.01); *F04D 29/44* (2013.01); *F04D 29/60* (2013.01); *F04D 29/68* (2013.01)

(56) References Cited

FOREIGN PATENT DOCUMENTS

| | | | | | |
|---|---|---|---|---|---|
| EP | 0381758 | | * | 8/1990 | |
| JP | 2000-240590 | A | | 9/2000 | |
| JP | 2001-329994 | A | | 11/2001 | |
| JP | 3516909 | B2 | | 4/2004 | |
| JP | 2005-030349 | A | | 2/2005 | |
| JP | 2005-069183 | A | | 3/2005 | |
| JP | 2011-226410 | A | | 11/2011 | |
| JP | 2020-503331 | A | | 11/2020 | |
| KR | 10-1493267 | B1 | | 3/2015 | |
| WO | WO-2019082378 | A1 | * | 5/2019 | ..... F04D 29/30 |
| WO | 2020/217367 | A1 | | 10/2020 | |

OTHER PUBLICATIONS

Translation of WO2019082378 (Year: 2019).*
International Search Report dated Jul. 23, 2019, issued in corresponding International Application No. PCT/JP2019/017548 (and English Machine Translation).
Office Action dated Jun. 21, 2021, issued in corresponding JP Patent Application No. 2020-150970 (and English Machine Translation).
Office Action dated Feb. 12, 2020, issued in corresponding JP Patent Application No. 2020-503331 (and English Machine Translation).
Office Action dated Jun. 5, 2020, issued in corresponding JP Patent Application No. 2020-503331 (and English Machine Translation).
Extended European Search Report dated Mar. 22, 2022 issued in corresponding European Patent Application No. 19925853.4.
Examination Report dated May 5, 2022 issued in corresponding IN Patent Application No. 202127047699. (and English translation).
Office Action dated Apr. 22, 2023 issued in corresponding CN patent application No. 201980095561.5 (and English translation).

* cited by examiner

Comparative Example

IMPELLER, MULTI-BLADE AIR-SENDING DEVICE, AND AIR-CONDITIONING APPARATUS

CROSS REFERENCE TO RELATED APPLICATION

This application is a U.S. National Stage Application of International Application No. PCT/JP2019/017548, filed on Apr. 25, 2019, the contents of which are incorporated herein by reference.

TECHNICAL FIELD

The present disclosure relates to an impeller, a multi-blade air-sending device including the impeller, and an air-conditioning apparatus including the multi-blade air-sending device.

BACKGROUND ART

Hitherto, a multi-blade air-sending device has a volute scroll casing and an impeller housed inside the scroll casing and configured to rotate around an axis (see, for example, Patent Literature 1). The impeller of the multi-blade air-sending device of Patent Literature 1 has a discoid backing plate, an annular rim, and blades arranged radially. The blades of the impeller are configured such that main blades and intermediate blades are alternately arranged and the inside diameters of the main and intermediate blades increase from the backing plate toward the rim. Further, each of the blades of the impeller is a sirocco blade (forward-swept blade) having a blade outlet angle of larger than or equal to 100 degrees, includes an inducer portion of a turbo blade (swept-back blade) as an inner circumferential portion of the blade, and is configured such that the ratio of the blade inside diameter to the blade outside diameter of the main blades beside the backing plate is lower than or equal to 0.7.

CITATION LIST

Patent Literature

Patent Literature 1: Japanese Unexamined Patent Application Publication No. 2000-240590

SUMMARY OF INVENTION

Technical Problem

However, the multi-blade air-sending device of Patent Literature 1 cannot expect sufficient pressure recovery from the intermediate blades, as the ratio of an outer circumferential sirocco blade and the ratio of an inner circumferential turbo blade of each of the intermediate blades are about equal. Further, the multi-blade air-sending device of Patent Literature 1 cannot expect sufficient pressure recovery from the blades beside the rim, as the blades of the impeller are sirocco blades beside the rim.

The present disclosure is intended to solve the aforementioned problem, and has as an object to provide an impeller capable of improving pressure recovery, a multi-blade air-sending device including the impeller, and an air-conditioning apparatus including the multi-blade air-sending device.

Solution to Problem

An impeller according to an aspect of the present disclosure includes a backing plate configured to be driven by rotating, an annular rim disposed so as to face the backing plate, and a plurality of blades arranged in a circumferential direction around a virtual rotation axis of the backing plate. One end of each of the plurality of blades is connected with the backing plate, and the other end of each of the plurality of blades is connected with the rim. Each of the plurality of blades has an inner circumferential end located closer to the rotation axis in a radial direction around the rotation axis, an outer circumferential end located closer to an outer circumference than the inner circumferential end in the radial direction, a sirocco blade portion being forward-swept and including the outer circumferential end and having a blade outlet angle of larger than 90 degrees, and a turbo blade portion being swept-back and including the inner circumferential end, a first region located closer to the backing plate than a middle point in an axial direction of the rotation axis, and a second region located closer to the rim than the first region. Each of the plurality of blades is formed such that a blade length in the first region is longer than a blade length in the second region. In the first region and the second region, a ratio of the turbo blade portion in the radial direction is larger than a ratio of the sirocco blade portion in the radial direction.

A multi-blade air-sending device according to an aspect of the present disclosure includes the impeller thus configured and a scroll casing housing the impeller and having a peripheral wall formed into a volute shape and a side wall having a bellmouth forming an air inlet communicating with a space formed by the backing plate and the plurality of blades.

An air-conditioning apparatus according to an aspect of the present disclosure includes the multi-blade air-sending device thus configured.

Advantageous Effects of Invention

According to an aspect of the present disclosure, in the first and second regions of the impeller, the ratio of the turbo blade portion in the radial direction is larger than the ratio of the sirocco blade portion in the radial direction. The impeller and the multi-blade air-sending device have a high ratio of the turbo blade portion in any region between the backing plate and the rim, can achieve sufficient pressure recovery through the blades, and can better improve pressure recovery than an impeller or a multi-blade air-sending device that does not include such a configuration.

DESCRIPTION OF EMBODIMENTS

In the following, an impeller, a multi-blade air-sending device, and an air-conditioning apparatus according to an embodiment are described, for example, with reference to the drawings. In the following drawings including FIG. 1, relative relationships in dimension between components, the shapes of the components, or other features of the components may be different from actual ones. Further, components given identical signs in the following drawings are identical or equivalent to each other, and these signs are adhered to throughout the full text of the description. Further, the directive terms (such as "upper", "lower", "right", "left", "front", and "back") used as appropriate for ease of comprehension are merely so written for convenience of explanation, and are not intended to limit the placement or orientation of a device or a component.

Embodiment 1

[Multi-Blade Air-Sending Device 100]

Figure 1:
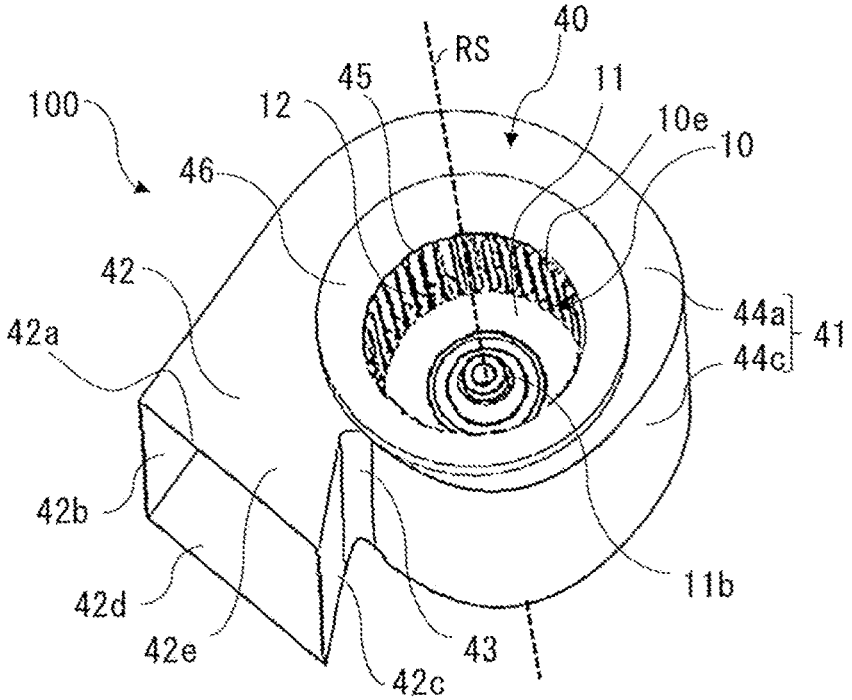
FIG. 1 is a perspective view schematically illustrating a multi-blade air-sending device according to Embodiment 1.
Figure 2:
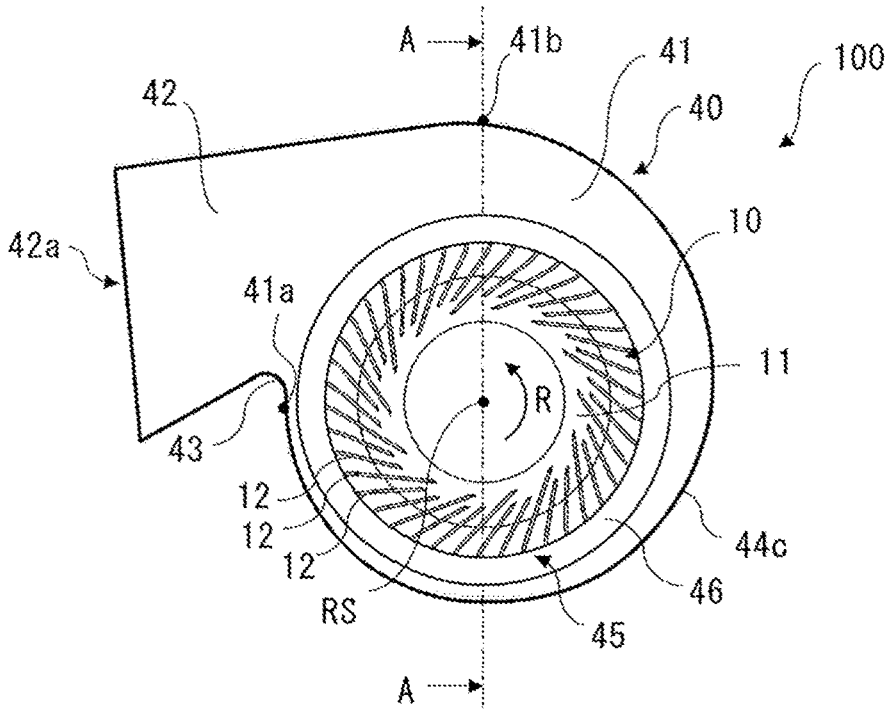
FIG. 2 is an outside drawing schematically illustrating a configuration of the multi-blade air-sending device according to Embodiment 1 as viewed from an angle parallel with a rotation axis.
Figure 3:
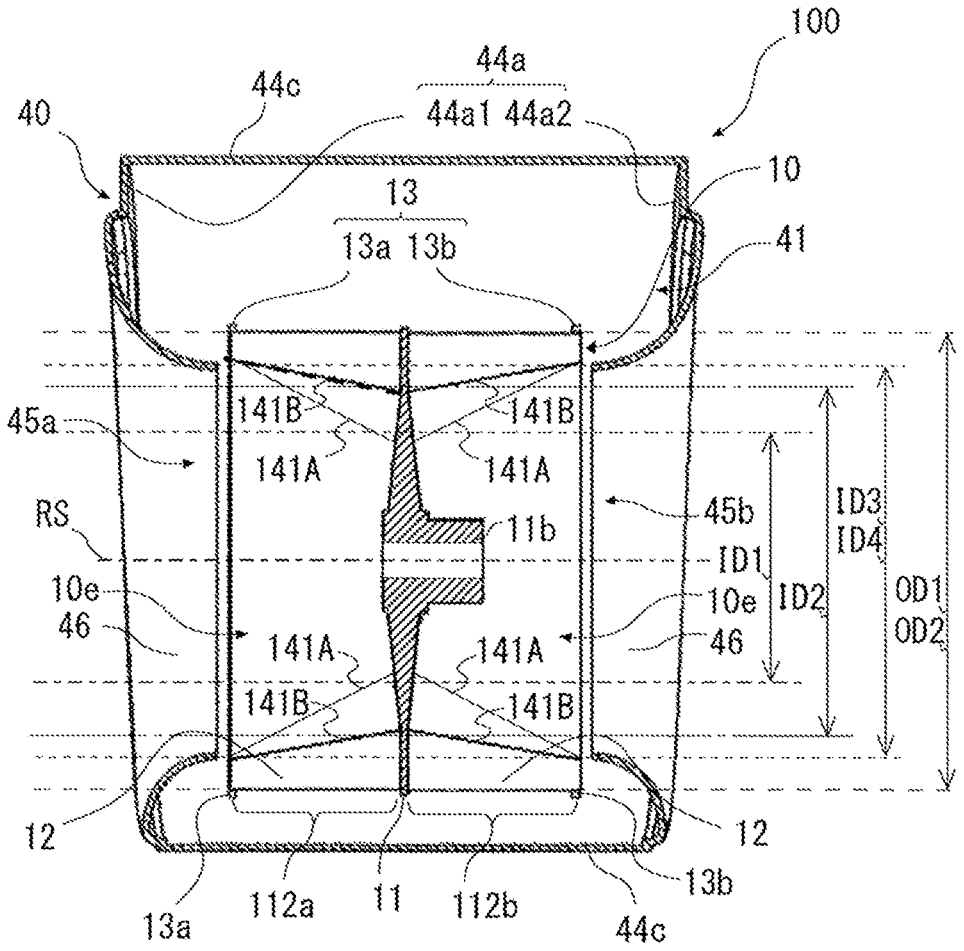
FIG. 3 is a schematic cross-sectional view of the multi-blade air-sending device as taken along line A-A in FIG. 2.

FIG. 1 is a perspective view schematically illustrating a multi-blade air-sending device 100 according to Embodiment 1. FIG. 2 is an outside drawing schematically illustrating a configuration of the multi-blade air-sending device 100 according to Embodiment 1 as viewed from an angle parallel with a rotation axis RS. FIG. 3 is a schematic cross-sectional view of the multi-blade air-sending device 100 as taken along line A-A in FIG. 2. A basic structure of the multi-blade air-sending device 100 is described with reference to FIGS. 1 to 3. It should be noted that FIGS. 1 to 3 schematically show an overall structure of the multi-blade air-sending device 100, and a configuration of blades 12, which is a special feature of the multi-blade air-sending device 100, is described in detail with reference to other drawings. The multi-blade air-sending device 100 is a double-suction centrifugal air-sending device into which air is suctioned through both ends in an axial direction of a virtual rotation axis RS of an impeller 10. The multi-blade air-sending device 100 is a multi-blade centrifugal air-sending device, and has an impeller 10 configured to generate a flow of gas and a scroll casing 40 housing the impeller 10 inside.

(Scroll Casing 40)

The scroll casing 40 houses the impeller 10 inside for use in the multi-blade air-sending device 100, and rectifies a flow of air blown out from the impeller 10. The scroll casing 40 has a scroll portion 41 and a discharge portion 42.

(Scroll Portion 41)

The scroll portion 41 forms an air trunk through which a dynamic pressure of a flow of gas generated by the impeller 10 is converted into a static pressure. The scroll portion 41 has a side wall 44*a* covering the impeller 10 from an axial direction of a rotation axis RS of a shaft portion 11*b* of the impeller 10 and having formed therein an air inlet 45 through which air is taken in and a peripheral wall 44*c* surrounding the impeller 10 from a radial direction of the rotation axis RS of the shaft portion 11*b* of the impeller 10. Further, the scroll portion 41 has a tongue 43 located between the discharge portion 42 and a scroll start portion 41*a* of the peripheral wall 44*c* to form a curved surface and configured to guide the flow of gas generated by the impeller 10 toward a discharge port 42*a* via the scroll portion 41. The radial direction of the rotation axis RS is a direction perpendicular to the axial direction of the rotation axis RS. An internal space of the scroll portion 41 formed by the peripheral wall 44*c* and the side wall 44*a* serves as a space in which the air blown out from the impeller 10 flows along the peripheral wall 44*c*.

(Side Wall 44*a*)

The side wall 44*a* is disposed at both sides of the impeller 10 in the axial direction of the rotation axis RS of the impeller 10. In the side wall 44*a* of the scroll casing 40, the air inlet 45 is formed so that air can flow between the impeller 10 and the outside of the scroll casing 40. The inlet port 45 is formed in a circular shape, and is disposed so that the center of the air inlet 45 and the center of the shaft portion 11*b* of the impeller 10 substantially coincide with each other. It should be noted that the shape of the air inlet 45 is not limited to the circular shape but may be another shape such as an elliptical shape. The scroll casing 40 of the multi-blade air-sending device 100 is a double-suction casing having side walls 44*a* at both sides of the backing plate 11 in the axial direction of the rotation axis RS of the shaft portion 11*b* with air inlets 45 formed in the side walls 44*a*. The multi-blade air-sending device 100 has two side walls 44*a* in the scroll casing 40. The two side walls 44*a* are formed so as to face each other via the peripheral wall 44*c*. More specifically, as shown in FIG. 3, the scroll casing 40 has a first side wall 44*a*1 and a second side wall 44*a*2 as the side walls 44*a*. The first side wall 44*a*1 forms a first air inlet 45*a* facing a plate surface of the backing plate 11 on which the after-mentioned first rim 13*a* is disposed. The second side wall 44*a*2 forms a second air inlet 45*b* facing a plate surface of the backing plate 11 on which the after-mentioned second rim 13*b* is disposed. It should be noted that the aforementioned air inlet 45 is a generic name for the first air inlet 45*a* and the second air inlet 45*b*.

The air inlet 45 provided in the side wall 44*a* is formed by a bellmouth 46. That is, the bellmouth 46 forms an air inlet 45 communicating with a space formed by the backing plate 11 and a plurality of blades 12. The bellmouth 46 rectifies a flow of gas to be suctioned into the impeller 10 and causes the flow of gas to flow into an air inlet 10*e* of the impeller 10. The bellmouth 46 has an opening having a diameter gradually decreasing from the outside toward the inside of the scroll casing 40. Such a configuration of the side wall 44*a* allows air near the air inlet 45 to smoothly flow along the bellmouth 46 and efficiently flow into the impeller 10 through the air inlet 45.

(Peripheral Wall 44*c*)

The peripheral wall 44*c* guides the flow of gas generated by the impeller 10 toward the discharge port 42*a* along a curved wall surface. The peripheral wall 44*a* is a wall provided between side walls 44*a* facing each other, and forms a curved surface in a direction of rotation R of the impeller 10. The peripheral wall 44*c* is for example disposed parallel with the axial direction of the rotation axis RS of the impeller 10 to cover the impeller 10. It should be noted that the peripheral wall 44*c* may be formed at a slant relative to the axial direction of the rotation axis RS of the impeller 10, and is not limited to being formed to be disposed parallel with the axial direction of the rotation axis RS. The peripheral wall 44*c* forms an inner circumferential surface covering the impeller 10 from the radial direction of the shaft portion 11*b* and facing the after-mentioned plurality of blades 12. The peripheral wall 44*c* faces a side of each of the blades 12 through which air is blown out from the impeller 10. As shown in FIG. 2, the peripheral wall 44*c* is provided over an area from the scroll start portion 41*a*, which is located at a boundary with the tongue 43, to a scroll end portion 41*b* located at a boundary between the discharge portion 42 and the scroll portion 41 at a side away from the tongue 43 along the direction of rotation R of the impeller 10. The scroll start portion 41*a* is an end portion of the peripheral wall 44*c*, which forms a curved surface, situated on an upstream side of a flow of gas generated by rotation of the impeller 10, and the scroll end portion 41*b* is an end portion of the peripheral wall 44*c* situated on a downstream side of the flow of gas generated by rotation of the impeller 10.

The peripheral wall 44*c* is formed in a volute shape. An example of the volute shape is a volute shape based on a logarithmic spiral, a spiral of Archimedes, or an involute curve. An inner peripheral surface of the peripheral wall 44*c* forms a curved surface smoothly curved along a circumferential direction of the impeller 10 from the scroll start portion 41*a*, at which the volute shape starts rolling, to the scroll end portion 41*b*, at which the volute shape finishes rolling. Such a configuration allows air sent out from the impeller 10 to smoothly flow through the space between the impeller 10 and the peripheral wall 44*c* in a direction toward the discharge portion 42. This effects an efficient rise in static pressure of air from the tongue 43 toward the discharge portion 42 in the scroll casing 40.

(Discharge Portion 42)

The discharge portion 42 forms a discharge port 42*a* through which a flow of gas generated by the impeller 10 and having passed through the scroll portion 41 is discharged. The discharge portion 42 is formed by a hollow pipe having a rectangular cross-section orthogonal to a flow direction of air flowing along the peripheral wall 44*c*. It should be noted that the cross-sectional shape of the discharge portion 42 is not limited to a rectangle. The discharge portion 42 forms a flow passage through which air sent out from the impeller 10 and flowing through a gap between the peripheral wall 44*c* and the impeller 10 is guided to be exhausted out of the scroll casing 40.

As shown in FIG. 1, the discharge portion 42 is formed by an extension plate 42*b*, a diffuser plate 42*c*, a first side plate portion 42*d*, a second side plate portion 42*e*, or other components. The extension plate 42*b* is formed integrally with the peripheral wall 44*c* so as to smoothly continue into the scroll end portion 41*b* downstream of the peripheral wall 44*c*. The diffuser plate 42*c* is formed integrally with the tongue 43 of the scroll casing 40 and faces the extension plate 42*b*. The diffuser plate 42*c* is formed at a predetermined angle to the extension plate 42*b* so that the cross-sectional area of the flow passage gradually increases along a flow direction of air in the discharge portion 42. The first side plate portion 42*d* is formed integrally with the first side wall 44*a*1 of the scroll casing 40, and the second side plate portion 42*e* is formed integrally with the opposite second side wall 44*a*2 of the scroll casing 40. Moreover, the first side plate portion 42*d* and the second side plate portion 42*e* are formed between the extension plate 42*b* and the diffuser plate 42*c*. Thus, the discharge portion 42 has a rectangular cross-section flow passage formed by the extension plate 42*b*, the diffuser plate 42*c*, the first side plate portion 42*d*, and the second side plate portion 42*e*.

(Tongue 43)

In the scroll casing 40, the tongue 43 is formed between the diffuser plate 42*c* of the discharge portion 42 and the scroll start portion 41*a* of the peripheral wall 44*c*. The tongue 43 is formed with a predetermined radius of curvature, and the peripheral wall 44*c* is smoothly connected with the diffuser plate 42*c* via the tongue 43. The tongue 43 reduces inflow of air from the scroll start to the scroll end of a volute flow passage. The tongue 43 is provided in an upstream part of a ventilation flue, and has a role to effect diversion into a flow of air in the direction of rotation R of the impeller 10 and a flow of air in a discharge direction from a downstream part of the ventilation flue toward the discharge port 42*a*. Further, a flow of air flowing into the discharge portion 42 rises in static pressure during passage through the scroll casing 40 to be higher in pressure than in the scroll casing 40. Therefore, the tongue 43 has a function of separating such different pressures.

(Impeller 10)

The impeller 10 is a centrifugal fan. The impeller 10 is driven into rotation, for example, by a motor (not illustrated). The rotation generates a centrifugal force with which the impeller 10 forcibly sends out air outward in a radial direction. The impeller 10 is rotated, for example, by the motor in a direction of rotation R indicated by an arrow. As shown in FIGS. 1 to 3, the impeller 10 has a backing plate 11 having a disk shape, an annular rim 13, and several blades 12 arranged radially in a circumferential direction of the backing plate 11 on a peripheral edge of the backing plate 11.

The backing plate 11 needs only be in the shape of a plate, and may, for example, have a non-disk shape such as a polygonal shape. Further, the backing plate 11 may be formed such that as shown in FIG. 3, the thickness of the backing plate 11 increases toward the center in a radial direction around the rotation axis RS, or may be formed such that the thickness is uniform in the radial direction around the rotation axis RS. The backing plate 11 has provided in a central part thereof a shaft portion 11*b* with which the motor (not illustrated) is connected. The backing plate 11 is driven into rotation by the motor via the shaft portion 11*b*.

The plurality of blades 12 are arranged in a circumferential direction around a virtual rotation axis RS of the backing plate 11. One end of each of the plurality of blades 12 is connected with the backing plate 11, and the other end of each of the plurality of blades 12 is connected with the rim 13. Each of the plurality of blades 12 is disposed between the backing plate 11 and the rim 13. The plurality of blades 12 are provided on both sides of the backing plate 11 in an axial direction of a rotation axis RS of the shaft portion 11*b*. The blades 12 are placed at regular spacings from each other on the peripheral edge of the backing plate 11. A configuration of the blades 12 will be described in detail later.

The annular rim 13 of the impeller 10 is attached to ends of the plurality of blades 12 opposite to the backing plate 11 in the axial direction of the rotation axis RS of the shaft portion 11*b*. The rim 13 is disposed in the impeller 10 so as to face the backing plate 11. The rim 13 couples the plurality of blades 12 with each other, thereby maintaining a positional relationship between the tip of each blade 12 and the tip of the other blade 12 and reinforcing the plurality of blades 12.

As shown in FIG. 3, the impeller 10 has the backing plate 11, a first blade portion 112*a*, and a second blade portion 112*b*. The first blade portion 112*a* and the second blade portion 112*b* are formed by the plurality of blades 12 and the rim 13. More specifically, the first blade portion 112*a* is formed by an annular first rim 13*a* disposed so as to face the backing plate 11 and a plurality of blades 12 disposed between the backing plate 11 and the first rim 13*a*. The second blade portion 112*b* is formed by an annular second blade portion 13*b* disposed on a side of the backing plate 11 opposite to the first rim 13*a* so as to face the backing plate 11 and a plurality of blades 12 disposed between the backing plate 11 and the second rim 13*b*. It should be noted that the rim 13 is a generic name for the first rim 13*a* and the second rim 13*b*, and the impeller 10 has the first rim 13*a* on one side of the backing plate 11 in the axial direction of the rotation axis RS, and has the second rim 13*b* on the other side.

The first blade portion 112*a* is disposed on one plate surface of the backing plate 11, and the second blade portion 112*b* is disposed on the other plate surface of the backing plate 11. That is, the plurality of blades 12 are provided on both sides of the backing plate 11 in the axial direction of the rotation axis RS, and the first blade portion 112*a* and the second blade portion 112*b* are provided back to back with each other via the backing plate 11. In FIG. 3, the first blade portion 112*a* is disposed on the left side of the backing plate 11, and the second blade portion 112*b* is disposed on the right side of the backing plate 11. However, the first blade portion 112*a* and the second blade portion 112*b* need only be provided back to back with each other via the backing plate 11. The first blade portion 112*a* may be disposed on the right side of the backing plate 11, and the second blade portion 112*b* may be disposed on the left side of the backing plate 11. In the following description, those blades 12 which form the first blade portion 112*a* and those blades 12 which form the second blade portion 112*b* are collectively referred to as "blades 12" unless otherwise noted.

The impeller 10 is formed in a tubular shape by the plurality of blades 12 disposed on the backing plate 11. Moreover, the impeller 10 has an air inlet 10*e* formed at a side of the rim 13 opposite to the backing plate 11 in the axial direction of the rotation axis RS of the shaft portion 11*b* and configured to cause gas to flow into a space surrounded by the backing plate 11 and the plurality of blades 12. The impeller 10 has its blades 12 and rims 13 disposed on both plate surfaces, respectively, of the backing plate 11, and has its air inlets 10*e* formed at both plate surfaces, respectively, of the backing plate 11.

The impeller 10 is driven into rotation around the rotation axis RS by driving of the motor (not illustrated). The rotation of the impeller 10 causes gas outside the multi-blade air-sending device 100 to be suctioned into the space surrounded by the backing plate 11 and the plurality of blades 12 through the air inlet 45 formed in the scroll casing 40 and the air inlet 10*e* of the impeller 10. Moreover, the rotation of the impeller 10 causes air suctioned into the space surrounded by the backing plate 11 and the plurality of blades 12 to be sent out outward in a radial direction of the impeller 10 through a space between a blade 12 and an adjacent blade 12.

[Configuration of Blades 12 in Detail]

Figure 4:
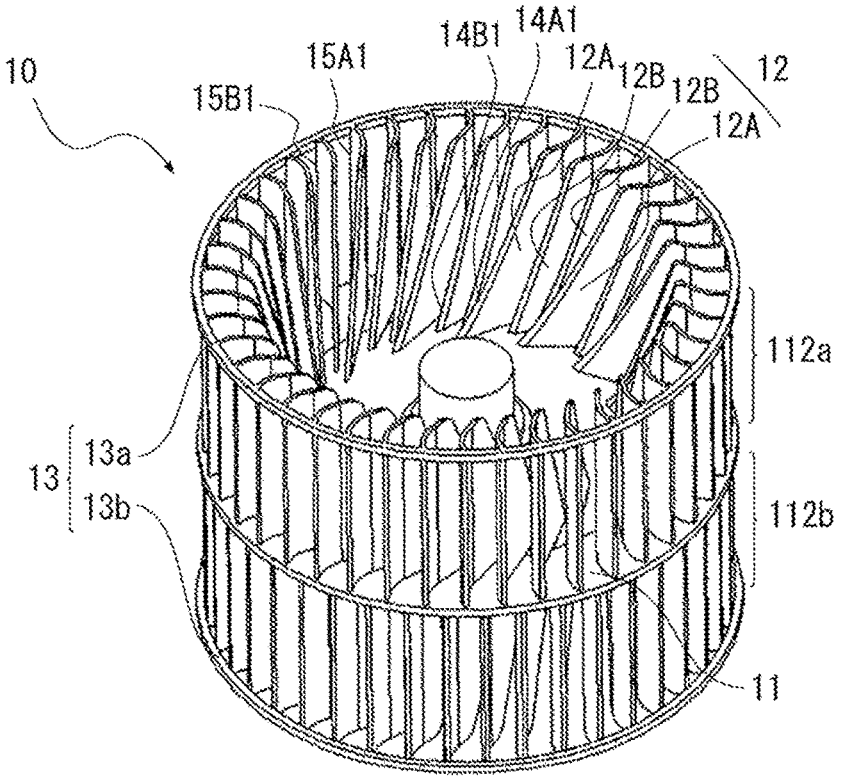
FIG. 4 is a perspective view of an impeller of the multi-blade air-sending device according to Embodiment 1.
Figure 5:
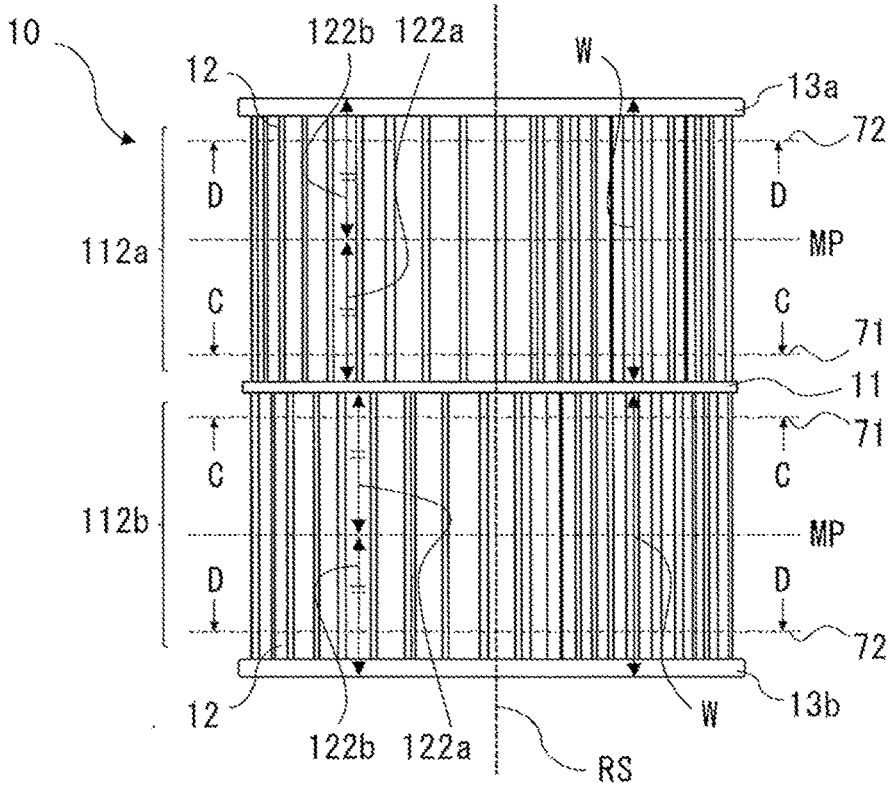
FIG. 5 is a side view of the impeller of FIG. 4.
Figure 6:
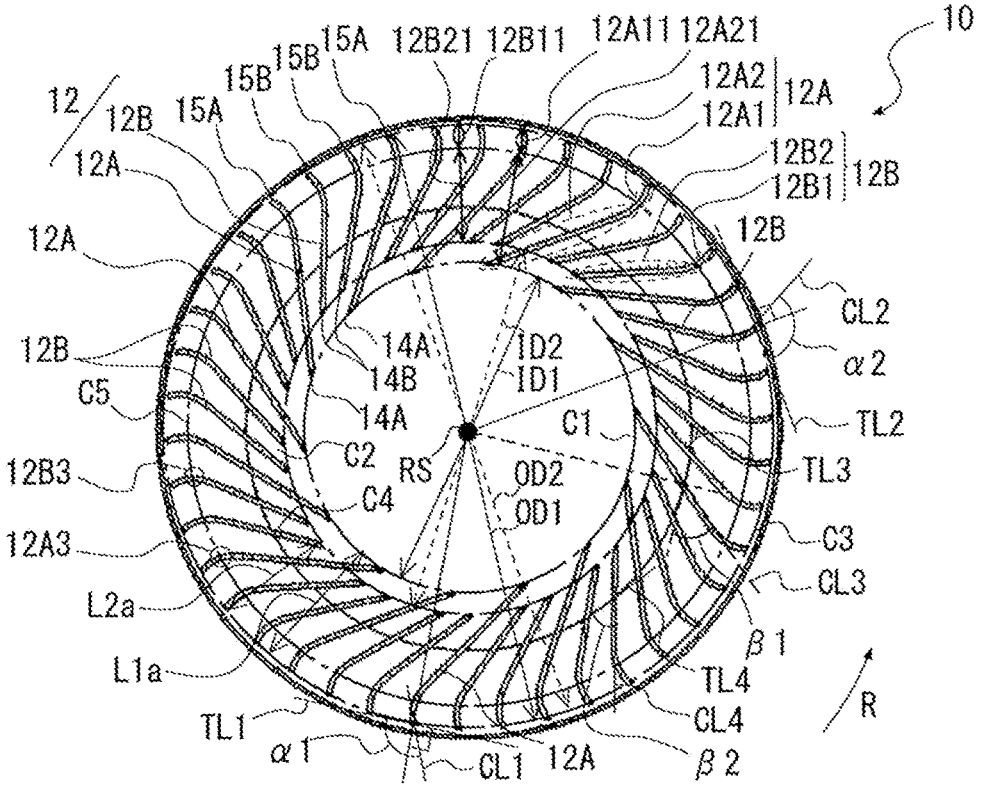
FIG. 6 is a schematic view of blades in a cross-section of the impeller as taken along line C-C in FIG. 5.
Figure 7:
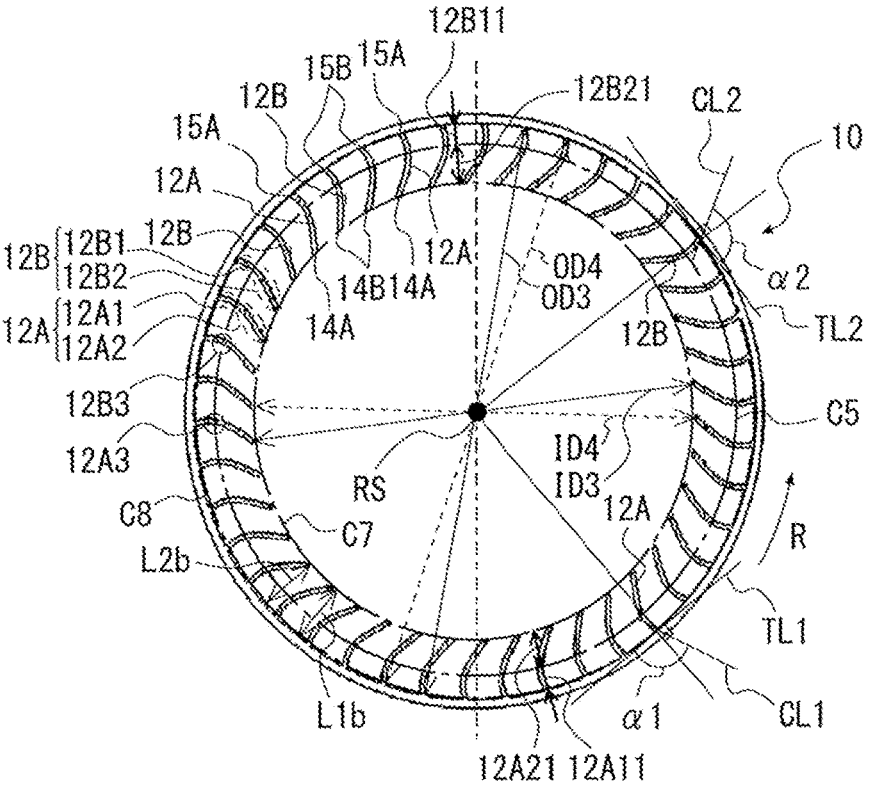
FIG. 7 is a schematic view of the blades in a cross-section of the impeller as taken along line D-D in FIG. 5.

FIG. 4 is a perspective view of the impeller 10 of the multi-blade air-sending device 100 according to Embodiment 1. FIG. 5 is a side view of the impeller 10 of FIG. 4. FIG. 6 is a schematic view of the blades 12 in a cross-section of the impeller 10 as taken along line C-C in FIG. 5. FIG. 7 is a schematic view of the blades 12 in a cross-section of the impeller 10 as taken along line D-D in FIG. 5. In FIG. 5, a middle point MP of the impeller 10 indicates a middle point in the axial direction of the rotation axis RS in the plurality of blades 12 forming the first blade portion 112*a*. Moreover, in the plurality of blades 12 forming the first blade portion 112*a*, a region from the middle point MP in the axial direction of the rotation axis RS to the backing plate 11 is a backing-plate-side blade region 122*a* serving as a first region of the impeller 10. Further, in the plurality of blades 12 forming the first blade portion 112*a*, a region from the middle point MP in the axial direction of the rotation axis RS to an end portion of the rim 13 is a rim-side blade region 122*b* serving as a second region of the impeller 10. That is, each of the plurality of blades 12 has a first region located closer to the backing plate 11 than the middle point MP in the axial direction of the rotation axis RS and a second region located closer to the rim 13 than the first region. As shown in FIG. 6, the cross-section taken along line C-C in FIG. 5 is a cross-section of the plurality of blades 12 beside the backing plate 11 of the impeller 10, that is, in the backing-plate-side blade region 122*a* serving as the first region. This cross-section of the blades 12 beside the backing plate 11 is a first cross-section of the impeller 10 made by cutting through a portion of the impeller 10 close to the backing plate 11 along a first plane 71 perpendicular to the rotation axis RS. Note here that the portion of the impeller 10 close to the backing plate 11 is, for example, a portion of the impeller 10 closer to the backing plate 11 than a middle point of the backing-plate-side blade region 122*a* in the axial direction of the rotation axis RS or a portion of the impeller 10 in which end portions of the blades 12 facing the backing plate 11 are located in the axial direction of the rotation axis RS. As shown in FIG. 7, the cross-section taken along line D-D in FIG. 5 is a cross-section of the plurality of blades 12 beside the rim 13 of the impeller 10, that is, in the rim-side blade region 122*b* serving as the second region. This cross-section of the blades 12 beside the rim 13 is a second cross-section of the impeller 10 made by cutting through a portion of the impeller 10 close to the backing plate 11 along a second plane 72 perpendicular to the rotation axis RS. Note here that the portion of the impeller 10 close to the rim 13 is, for example, a portion of the impeller 10 closer to the rim 13 than a middle point of the rim-side blade region 122*b* in the axial direction of the rotation axis RS or a portion of the impeller 10 in which end portions of the blades 12 facing the rim 13 are located in the axial direction of the rotation axis RS.

A configuration of the blades 12 in the second blade portion 112*b* is similar to a configuration of the blades 12 in the first blade portion 112*a*. That is, in FIG. 5, a middle point MP of the impeller 10 indicates a middle point in the axial direction of the rotation axis RS in the plurality of blades 12 forming the second blade portion 112*b*. Moreover, in the plurality of blades 12 forming the second blade portion 112*b*, a region from the middle point MP in the axial direction of the rotation axis RS to the backing plate 11 is a backing-plate-side blade region 122*a* serving as a first region of the impeller 10. Further, in the plurality of blades 12 forming the second blade portion 112*b*, a region from the middle point MP in the axial direction of the rotation axis RS to an end portion of the second rim 13*b* is a rim-side blade region 122*b* serving as a second region of the impeller 10. Although the foregoing description assumes that a configuration of the first blade portion 112*a* and a configuration of the second blade portion are the same, a configuration of the impeller 10 is not limited to such a configuration but may be a configuration in which the first blade portion 112*a* and the second blade portion 112*b* are different from each other. That is, both or either the first blade portion 112*a* and/or the second blade portion 112*b* may have the configuration of the blades 12 to be described below. The following describes the configuration of the blades 12 in detail with reference to FIGS. 4 to 7.

As shown in FIGS. 4 to 7, the plurality of blades 12 include a plurality of first blades 12A and a plurality of second blades 12B. The plurality of blades 12 includes an alternate arrangement of a first blade 12A and or more second blades 12B in the circumferential direction of the impeller 10. As shown in FIGS. 4 and 6, the impeller 10 has two second blades 12B disposed between a first blade 12A and a first blade 12A disposed adjacent to the first blade 12A in the direction of rotation R. Note, however, that the number of second blades 12B that are disposed between a first blade 12A and a first blade 12A disposed adjacent to the first blade 12A in the direction of rotation R is not limited to 2 but may be 1 or larger than or equal to 3. That is, at least one of the plurality of second blades 12B is disposed between two of the plurality of first blades 12A adjacent to each other in the circumferential direction.

As shown in FIG. 6, in the first cross-section of the impeller 10 as taken along the first plane 71 perpendicular to the rotation axis RS, each of the first blades 12A has an inner circumferential end 14A located closer to the rotation axis RS in a radial direction around the rotation axis RS and an outer circumferential end 15A located closer to an outer circumference than the inner circumferential end 14A in the radial direction. In each of the plurality of first blades 12A, the inner circumferential end 14A is disposed in front of the outer circumferential end 15A in the direction of rotation R of the impeller 10. As shown in FIG. 4, the inner circumferential end 14A serves as a leading edge 14A1 of the first blade 12A, and the outer circumferential end 15A serves as a trailing edge 15A1 of the first blade 12A. As shown in FIG. 6, the impeller 10 has fourteen first blades 12A disposed therein. However, the number of first blades 12A is not limited to 14 but may be smaller or larger than 14.

As shown in FIG. 6, in the first cross-section of the impeller 10 as taken along the first plane 71 perpendicular to the rotation axis RS, each of the second blades 12B has an inner circumferential end 14B located closer to the rotation axis RS in a radial direction around the rotation axis RS and an outer circumferential end 15B located closer to an outer circumference than the inner circumferential end 14B in the radial direction. In each of the plurality of second blades 12B, the inner circumferential end 14B is disposed in front of the outer circumferential end 15B in the direction of rotation R of the impeller 10. As shown in FIG. 4, the inner circumferential end 14B serves as a leading edge 14B1 of the second blade 12B, and the outer circumferential end 15B serves as a trailing edge 15B1 of the second blade 12B. As shown in FIG. 6, the impeller 10 has twenty-eight second blades 12B disposed therein. However, the number of second blades 12B is not limited to 28 but may be smaller or larger than 28.

The following describes a relationship between the first blades 12A and the second blades 12B. As shown in FIGS. 4 and 7, the blade length of each of portions of each of the first blades 12A closer to the first rim 13*a* and the second rim 13*b* than the middle points MP in a direction along the rotation axis RS is equal to the blade length of each of portions of each of the second blades 12B closer to the first rim 13*a* and the second rim 13*b* than the middle points MP in the direction along the rotation axis RS. Meanwhile, as shown in FIGS. 4 and 6, the blade length of a portion each of the first blades 12A closer to the backing plate 11 than the middle point MP in the direction along the rotation axis RS is greater than the blade length of a portion of each of the second blades 12B closer to the backing plate 11 than the middle point MP in the direction along the rotation axis RS, and increases toward the backing plate 11. Thus, in the present embodiment, the blade length of at least a portion of each of the first blades 12A in the direction along the rotation axis RS is greater than the blade length of at least a portion of each of the second blades 12B in the direction along the rotation axis RS. It should be noted that the term "blade length" here means the length of each of the first blades 12A in the radial direction of the impeller 10 and the length of each of the second blades 12B in the radial direction of the impeller 10.

As shown in FIG. 6, in the first cross-section closer to the backing plate 11 than the middle point MP shown in FIG. 5, the diameter of a circle C1 passing through the inner circumferential ends 14*a* of the plurality of first blades 12A around the rotation axis RS, that is, the inside diameter of the first blades 12A, is assumed to be an inside diameter ID1. The diameter of a circle C3 passing through the outer circumferential ends 15A of the plurality of first blades 12A around the rotation axis RS, that is, the outside diameter of the first blades 12A, is assumed to be an outside diameter OD1. One-half of the difference between the outside diameter OD1 and the inside diameter ID1 is equal to the blade length L1*a* of each of the first blades 12A in the first cross-section (Blade Length L1*a*=(Outside Diameter OD1−Inside Diameter ID1)/2). Note here that the ratio of the inside diameter to the outside diameter of the first blades 12A is lower than or equal to 0.7. That is, the plurality of first blades 12A are configured such that the ratio of the inside diameter ID1 formed by the inner circumferential end 14A of each of the plurality of first blades 12A and to the outside diameter OD1 formed by the outer circumferential end 15A of each of the plurality of first blades 12A is lower than or equal to 0.7. It should be noted that in a common multi-blade air-sending device, the blade length of a blade in a cross-section perpendicular to a rotation axis is shorter than the width dimension of a blade in a direction parallel with the rotation axis. In the present embodiment, too, the maximum blade length of each of the first blades 12A, that is, the blade length of an end portion of each of the first blades 12A close to the backing plate 11, is shorter than the width dimension W (see FIG. 5) of each of the first blades 12A in the direction parallel with the rotation axis.

Further, in the first cross-section, the diameter of a circle C2 passing through the inner circumferential ends 14B of the plurality of second blades 12B around the rotation axis RS, that is, the inside diameter of the second blades 12B, is assumed to be an inside diameter ID2 that is larger than the inside diameter ID1 (Inside Diameter ID2>Inside Diameter 101). The diameter of the circle C3 passing through the outer circumferential ends 15B of the plurality of second blades 12B around the rotation axis RS, that is, the outside diameter of the second blades 12B, is assumed to be an outside diameter OD2 that is equal to the outside diameter OD1 (Outside Diameter OD2=Outside Diameter OD1). One-half of the difference between the outside diameter OD2 and the inside diameter ID2 is equal to the blade length L2*a* of each of the second blades 12B in the first cross-section (Blade Length L2*a*=(Outside Diameter OD2−Inside Diameter ID2)/2). The blade length L2*a* of each of the second blades 12B in the first cross-section is shorter than the blade length Lia of each of the first blades 12A in the same cross-section (Blade Length L2*a*<Blade Length Lia). Note here that the ratio of the inside diameter to the outside diameter of the second blades 12B is lower than or equal to 0.7. That is, the plurality of second blades 12B are configured such that the ratio of the inside diameter ID2 formed by the inner circumferential end 14B of each of the plurality of second blades 12B to the outside diameter OD2 formed by the outer circumferential end 15B of each of the plurality of second blades 12B is lower than or equal to 0.7.

Meanwhile, as shown in FIG. 7, in the second cross-section closer to the rim 13 than the middle point MP shown in FIG. 5, the diameter of a circle C7 passing through the inner circumferential ends 14A of the first blades 12A around the rotation axis RS is assumed to be an inside diameter ID3. The inside diameter ID3 is larger than the inside diameter ID1 of the first cross-section (Inside Diameter ID3>Inside Diameter ID1). The diameter of a circle C8 passing through the outer circumferential ends 15A of the first blades 12A around the rotation axis RS is assumed to be an outside diameter OD3. One-half of the difference between the outside diameter OD3 and the inside diameter ID1 is equal to the blade length L1*b* of each of the first blades 12A in the second cross-section (Blade Length L1*b*=(Outside Diameter OD3−Inside Diameter ID3)/2).

Further, let it be assumed that in the second cross-section, the diameter of the circle C7 passing through the inner circumferential ends 14B of the second blades 12B around the rotation axis RS is an inside diameter ID4. The inside diameter ID4 is equal to the inside diameter ID3 in the same cross-section (Inside Diameter ID4=Inside Diameter ID3). The diameter of the circle C8 passing through the outer circumferential ends 15B of the second blades 12B around the rotation axis RS is assumed to be an outside diameter OD4. The outside diameter OD4 is equal to the outside diameter OD3 in the same cross-section (Outside Diameter OD4=Outside Diameter OD3). One-half of the difference between the outside diameter OD4 and the inside diameter ID4 is equal to the blade length L2*b* of each of the second blades 12B in the second cross-section (Blade Length L2*b*=(Outside Diameter OD4−Inside Diameter ID4)/2). The blade length L2*b* of each of the second blades 12B in the second cross-section is equal to the blade length L1*b* of each of the first blades 12A in the same cross-section (Blade Length L2*b*=Blade Length Lib).

When viewed from an angle parallel with the rotation axis RS, the first blades 12A in the second cross-section shown in FIG. 7 overlap the first blades 12A in the first cross-section shown in FIG. 6 so as not to extend off the contours of the first blades 12A. For this reason, the impeller 10 satisfies the relationships "Outside Diameter OD3=Outside Diameter OD1", "Inside Diameter ID3≥Inside Diameter ID1", and "Blade Length L1*b*≤Blade Length L1*a*".

Similarly, when viewed from an angle parallel with the rotation axis RS, the second blades 12B in the second cross-section shown in FIG. 7 overlap the second blades 12B in the first cross-section shown in FIG. 6 so as not to extend off the contours of the second blades 12B. For this reason, the impeller 10 satisfies the relationships "Outside Diameter OD4=Outside Diameter OD2", "Inside Diameter ID4≥Inside Diameter ID2", and "Blade Length L2*b*≤Blade Length L2*a*".

Note here that as mentioned above, the ratio of the inside diameter ID1 to the outside diameter OD1 of the first blades 12A is lower than or equal to 0.7. Since the blades 12 are configured such that Inside Diameter ID3≥Inside Diameter ID1, Inside Diameter ID4≥Inside Diameter ID2, and Inside Diameter ID2>Inside Diameter ID1, the inside diameter of the first blades 12A can be the blade inside diameter of the blades 12. Further, since the blades 12 are configured such that Outside Diameter OD3=Outside Diameter OD1, Outside Diameter OD4=Outside Diameter OD2, and Outside Diameter OD2=Outside Diameter OD1, the outside diameter of the first blades 12A can be the blade outside diameter of the blades 12. Moreover, in a case in which the blades 12 forming the impeller 10 are seen as a whole, the blades 12 are configured such that the ratio of the blade inside diameter to the blade outside diameter of the blades 12 is lower than or equal to 0.7. It should be noted that the blade inside diameter of the plurality of blades 12 is formed by the inner circumferential end of each of the plurality of blades 12. That is, the blade inside diameter of the plurality of blades 12 is formed by the leading edges 14A1 of the plurality of blades 12. Further, the blade outside diameter of the plurality of blades 12 is formed by the outer circumferential end of each of the plurality of blade 12. That is, the blade outside diameter of the plurality of blades 12 is formed by the trailing edges 15A1 and 15B1 of the plurality of blades 12.

[Configuration of First Blades 12A and Second Blades 12B]

In a comparison between the first cross-section shown in FIG. 6 and the second cross-section shown in FIG. 7, each of the first blades 12A has the relationship "Blade Length Lia>Blade Length L1*b*". That is, each of the plurality of blades 12 is formed such that a blade length in the first region is longer than a blade length in the second region. More specifically, each of the first blades 12A is formed such that its blade length decreases from the backing plate 11 toward the rim 13 in the axial direction of the rotation axis RS. Similarly, in a comparison between the first cross-section shown in FIG. 6 and the second cross-section shown in FIG. 7, each of the second blades 12B has the relationship "Blade Length L2*a*>Blade Length L2*b*". That is, each of the second blades 12B is formed such that the blade length decreases from the backing plate 11 toward the rim 13 in the axial direction of the rotation axis RS. Moreover, as shown in FIG. 3, the first blades 12A and the second blades 12B are inclined such that the blade inside diameter increases from the backing plate 11 toward the rim 13. That is, the plurality of blades 12 form an inclined portion 141A inclined such that the inner circumferential ends 14A forming the leading edges 14A1 extend away from the rotation axis RS so that the blade inside diameter increases from the backing plate 11 toward the rim 13. Similarly, the plurality of blades 12 form an inclined portion 141B inclined such that the inner circumferential ends 14B forming the leading edges 14B1 extend away from the rotation axis RS so that the blade inside diameter increases from the backing plate 11 toward the rim 13.

As shown in FIGS. 6 and 7, each of the first blades 12A has a first sirocco blade portion 12A1 being forward-swept and a first turbo blade portion 12A2 being swept-back. In the radial direction of the impeller 10, the first sirocco blade portion 12A1 forms an outer circumference of the first blade 12A, and the first turbo blade portion 12A2 forms an inner circumference of the first blade 12A. That is, each of the first blades 12A is configured such that the first turbo blade portion 12A2 and the first sirocco blade portion 12A1 are arranged in this order from the rotation axis RS toward the outer circumference in the radial direction of the impeller 10. In each of the first blades 12A, the first turbo blade portion 12A2 and the first sirocco blade portion 12A1 are integrally formed. The first turbo blade portion 12A2 forms the leading edge 14A1 of the first blade 12A, and the first sirocco blade portion 12A1 forms the trailing edge 15A1 of the first blade 12A. In the radial direction of the impeller 10, the first turbo blade portion 12A2 linearly extends from the inner circumferential end 14A forming the leading edge 14A1 toward the outer circumference.

In the radial direction of the impeller 10, a region forming the first sirocco blade portion 12A1 of each of the first blades 12A is defined as a first sirocco region 12A11, and a region forming the first turbo blade portion 12A2 of each of the first blades 12A is defined as a first turbo region 12A21. Each of the first blades 12A is configured such that the first turbo region 12A21 is larger than the first sirocco region 12A11 in the radial direction of the impeller 10. Moreover, in both the backing-plate-side blade region 122*a* serving as the first region and the rim-side blade region 122*b* serving as the second region, the impeller 10 has the relationship "First Sirocco Region 12A11<First Turbo Region 12A21" in the radial direction of the impeller 10. That is, the impeller 10 and each of the first blades 12A are configured such that in both the backing-plate-side blade region 122*a* serving as the first region and the rim-side blade region 122*b* serving as the second region, a ratio of the first turbo blade portion 12A2 is larger than a ratio of the first sirocco blade portion 12A1 in the radial direction of the impeller 10.

Similarly, as shown in FIGS. 6 and 7, each of the second blades 12B has a second sirocco blade portion 12B1 being forward-swept and a second turbo blade portion 12B2 being swept-back. In the radial direction of the impeller 10, the second sirocco blade portion 12B1 forms an outer circumference of the second blade 12B, and the second turbo blade portion 12B2 forms an inner circumference of the second blade 12B. That is, each of the second blades 12B is configured such that the second turbo blade portion 12B2 and the second sirocco blade portion 12B1 are arranged in this order from the rotation axis RS toward the outer circumference in the radial direction of the impeller 10. In each of the second blades 12B, the second turbo blade portion 12B2 and the second sirocco blade portion 12B1 are integrally formed. The second turbo blade portion 12B2 forms the leading edge 14B1 of the second blade 12B, and the first sirocco blade portion 12B1 forms the trailing edge 15B1 of the second blade 12B. In the radial direction of the impeller 10, the second turbo blade portion 12B2 linearly extends from the inner circumferential end 14B forming the leading edge 14B1 toward the outer circumference.

In the radial direction of the impeller 10, a region forming the second sirocco blade portion 12B1 of each of the second blades 12B is defined as a second sirocco region 12B11, and a region forming the second turbo blade portion 12B2 of each of the second blades 12B is defined as a second turbo region 12B21. Each of the second blades 12B is configured such that the second turbo region 12B21 is larger than the second sirocco region 12B11 in the radial direction of the impeller 10. Moreover, in both the backing-plate-side blade region 122*a* serving as the first region and the rim-side blade region 122*b* serving as the second region, the impeller 10 has the relationship "Second Sirocco Region 12B11<Second Turbo Region 12B21" in the radial direction of the impeller 10. That is, the impeller 10 and each of the second blades 12B are configured such that in both the backing-plate-side blade region 122*a* serving as the first region and the rim-side blade region 122*b* serving as the second region, a ratio of the second turbo blade portion 12B2 is larger than a ratio of the second sirocco blade portion 12B1 in the radial direction of the impeller 10.

According to the foregoing configuration, the plurality of blades 12 are configured such that in both the backing-plate-side blade region 122*a* and the rim-side blade region 122*b*, a region of a turbo blade portion is larger than a region of a sirocco blade portion in the radial direction of the impeller 10. That is, the plurality of blades 12 are configured such that in both the backing-plate-side blade region 122*a* and the rim-side blade region 122*b*, a ratio of the turbo blade portion is larger than a ratio of the sirocco blade portion in the radial direction of the impeller 10, and have the relationship "Sirocco Region<Turbo Region". In other words, each of the plurality of blades 12 is configured such that in the first region and the second region, a ratio of the turbo blade portion in the radial direction is larger than a ratio of the sirocco blade portion in the radial direction.

As shown in FIG. 6, a blade outlet angle of the first sirocco blade portion 12A1 of each of the first blades 12A in the first cross-section is assumed to be a blade outlet angle $\alpha 1$. The blade outlet angle $\alpha 1$ is defined as an angle formed by a tangent line TL1 and a center line CL1 of the first sirocco blade portion 12A1 at the outer circumferential end 15A at an intersection of a segment of the circle C3 around the rotation axis RS and the outer circumferential end 15A. This blade outlet angle $\alpha 1$ is an angle of larger than 90 degrees. A blade outlet angle of the second sirocco blade portion 12B1 of each of the second blades 12B in the same cross-section is assumed to be a blade outlet angle $\alpha 2$. The blade outlet angle $\alpha 2$ is defined as an angle formed by a tangent line TL2 and a center line CL2 of the second sirocco blade portion 12B1 at the outer circumferential end 15B at an intersection of a segment of the circle C3 around the rotation axis RS and the outer circumferential end 15B. The blade outlet angle $\alpha 2$ is an angle of larger than 90 degrees. The blade outlet angle a2 of the second sirocco blade portion 12B1 is equal to the blade outlet angle $\alpha 1$ of the first sirocco blade portion 12A1 (Blade Outlet Angle α2=Blade Outlet Angle α1). The first sirocco blade portion 12A1 and the second sirocco blade portion 12B1 are formed in arcs to curve out in a direction opposite to the direction of rotation R when viewed from an angle parallel with the rotation axis RS.

As shown in FIG. 7, the impeller 10 is configured such that in the second cross-section, too, the blade outlet angle α1 of the first sirocco blade portion 12A1 and the blade outlet angle α2 of the second sirocco blade portion 12B1 are equal to each other. That is, each of the plurality of blades 12 has a sirocco blade portion being forward-swept and extending from the backing plate 11 to the rim 13 and having a blade outlet angle of larger than 90 degrees.

Further, as shown in FIG. 6, a blade outlet angle of the first turbo blade portion 12A2 of each of the first blades 12A in the first cross-section is assumed to be a blade outlet angle β1. The blade outlet angle β1 is defined as an angle formed by a tangent line TL3 and a center line CL3 of the first turbo blade portion 12A2 at an intersection of a segment of a circle C4 around the rotation axis RS and the first turbo blade portion 12A2. This blade outlet angle β1 is an angle of smaller than 90 degrees. A blade outlet angle of the second turbo blade portion 12B2 of each of the second blades 12B in the same cross-section is assumed to be a blade outlet angle β2. The blade outlet angle β2 is defined as an angle formed by a tangent line TL4 and a center line CL4 of the second turbo blade portion 12B2 at an intersection of a segment of the circle C4 around the rotation axis RS and the second turbo blade portion 12B2. The blade outlet angle β2 is an angle of smaller than 90 degrees. The blade outlet angle β2 of the second turbo blade portion 12B2 is equal to the blade outlet angle β1 of the first turbo blade portion 12A2 (Blade Outlet Angle β2=Blade Outlet Angle β1).

Although not illustrated in FIG. 7, the impeller 10 is configured such that in the second cross-section, too, the blade outlet angle β1 of the first turbo blade portion 12A2 and the blade outlet angle β2 of the second turbo blade portion 12B2 are equal to each other. Further, the blade outlet angle β1 and the blade outlet angle β2 are angles of smaller than 90 degrees.

As shown in FIGS. 6 and 7, each of the first blades 12A has a first radial blade portion 12A3 serving as a portion of connection between the first turbo blade portion 12A2 and the first sirocco blade portion 12A1. The first radial blade portion 12A3 is a portion configured to be a radial blade linearly extending in the radial direction of the impeller 10. Similarly, each of the second blades 12B has a second radial blade portion 12B3 serving as a portion of connection between the second turbo blade portion 12B2 and the second sirocco blade portion 12B1. The second radial blade portion 12B3 is a portion configured to be a radial blade linearly extending in the radial direction of the impeller 10. The first radial blade portion 12A3 and the second radial blade portion 12B3 each have a blade angle of 90 degrees. More specifically, an angle formed by a tangent line at an intersection of a center line of the first radial blade portion 12A3 and a circle C5 around the rotation axis RS and the center line of the first radial blade portion 12A3 is 90 degrees. Further, an angle formed by a tangent line at an intersection of a center line of the second radial blade portion 12B3 and the circle C5 around the rotation axis RS and the center line of the second radial blade portion 12B3 is 90 degrees.

When a spacing between two of the plurality of blades 12 adjacent to each other in the circumferential direction is defined as a blade spacing, the blade spacing between a plurality of blades 12 widens from the leading edges 14A1 toward the trailing edges 15A1 as shown in FIGS. 6 and 7. Similarly, the blade spacing between a plurality of blades 12 widens from the leading edges 14B1 toward the trailing edges 15B1. Specifically, a blade spacing in the turbo blade portion formed by the first turbo blade portion 12A2 and the second turbo blade portion 12B2 widens from the inner circumference toward the outer circumference. Moreover, a blade spacing in a sirocco blade portion formed by a first sirocco blade portion 12A1 and a second sirocco blade portion 12B1 is wider than the blade spacing in the turbo blade portion and widens from the inner circumference toward the outer circumference. That is, a blade spacing between a first turbo blade portion 12A2 and a second turbo blade portion 12B2 or a blade spacing between adjacent second turbo blade portions 12B2 widens from the inner circumference toward the outer circumference. Further, a blade spacing between a first sirocco blade portion 12A1 and a second sirocco blade portion 12B1 or a blade spacing between adjacent second sirocco blade portions 12B1 is wider than the blade spacing in the turbo blade portion and widens from the inner circumference toward the outer circumference.

[Relationship Between Impeller 10 and Scroll Casing 40]

Figure 8:
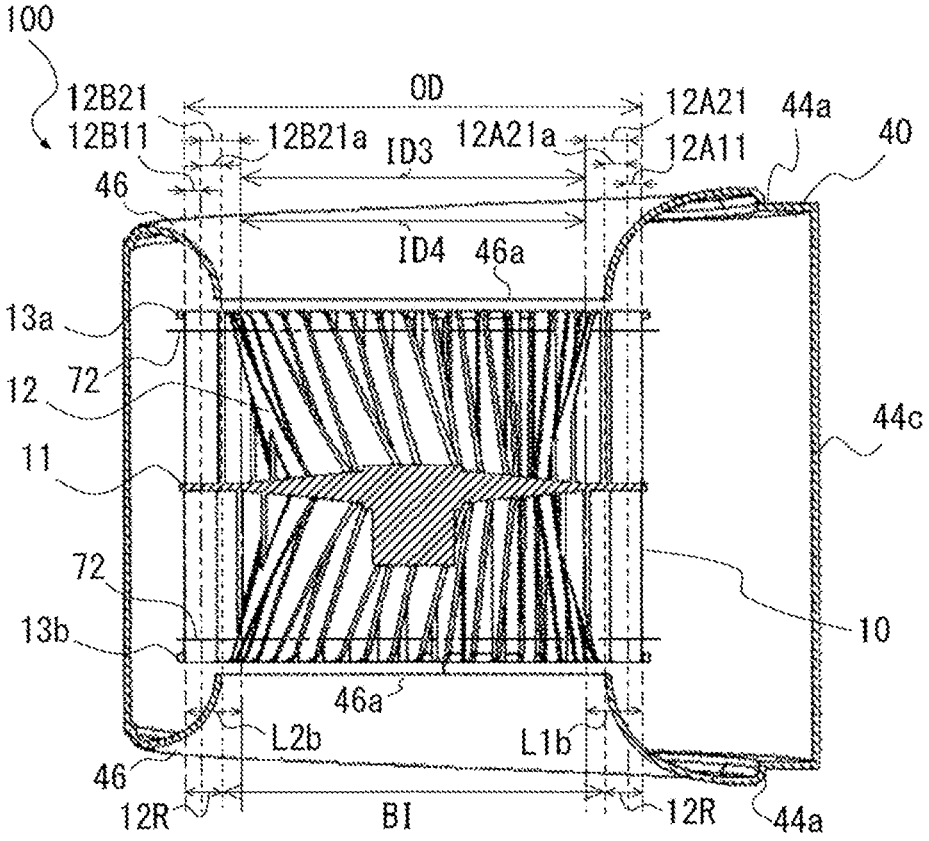
FIG. 8 is a schematic view illustrating a relationship between the impeller and bellmouths in a cross-section of the multi-blade air-sending device as taken along line A-A in FIG. 2.
Figure 9:
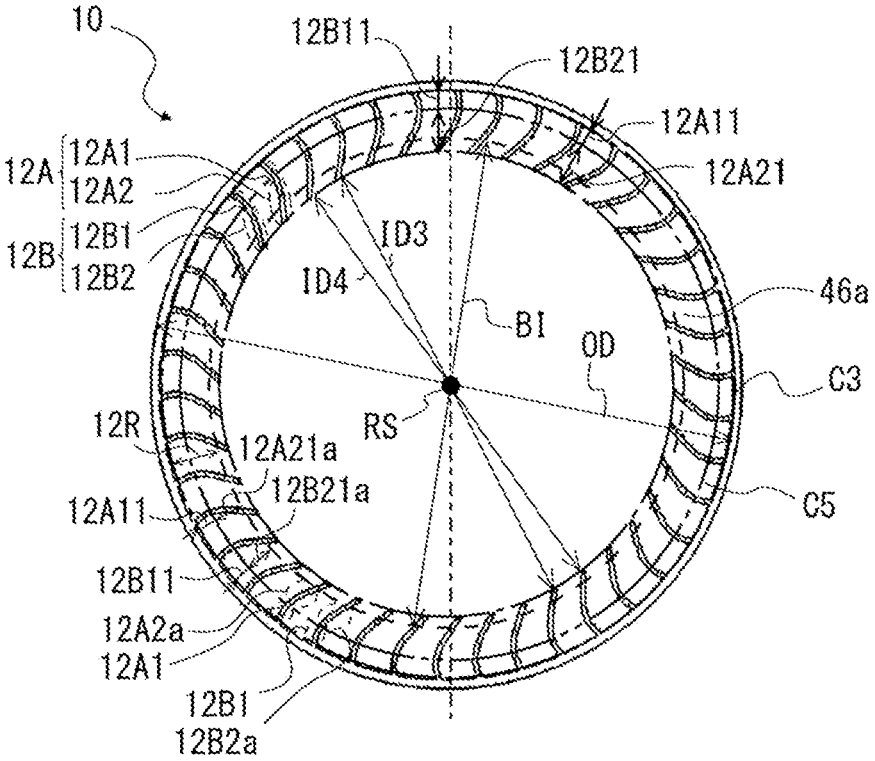
FIG. 9 is a schematic view illustrating a relationship between blades and a bellmouth as viewed from an angle parallel with the rotation axis in a second cross-section of the impeller in FIG. 8.

FIG. 8 is a schematic view illustrating a relationship between the impeller 10 and bellmouths 46 in a cross-section of the multi-blade air-sending device 100 as taken along line A-A in FIG. 2. FIG. 9 is a schematic view illustrating a relationship between blades 12 and a bellmouth 46 as viewed from an angle parallel with the rotation axis RS in a second cross-section of the impeller 10 in FIG. 8. As shown in FIGS. 8 and 9, a blade outside diameter OD formed by the outer circumferential end of each of the plurality of blades 12 is larger than the inside diameter BI of a bellmouth 46 forming the scroll casing 40. It should be noted that the blade outside diameter OD of the plurality of blades 12 is equal to the outside diameters OD1 and OD2 of the first blades 12A and the outside diameter OD3 and OD4 of the second blades 12B (Blade Outside Diameter OD=Outside Diameter OD1=Outside Diameter OD2=Outside Diameter OD3=Outside Diameter OD4).

The impeller 10 is configured such that the first turbo region 12A21 is larger than the first sirocco region 12A11 in the radial direction relative to the rotation axis RS. That is, the impeller 10 and each of the first blades 12A are configured such that the ratio of the first turbo blade portion 12A2 is larger than the ratio of the first sirocco blade portion 12A1 in the radial direction relative to the rotation axis RS, and have the relationship "First Sirocco Blade Portion 12A1<First Turbo Blade Portion 12A2". The relationship between the ratio of the first sirocco blade portion 12A1 and the ratio of the first turbo blade portion 12A2 in the radial direction of the rotation axis RS holds in both the backing-plate-side blade region 122*a* serving as the first region and the rim-side blade region 122*b* serving as the second region.

Furthermore, a region of portions of the plurality of blades 12 situated closer to the outer circumference than the inside diameter BI of the bellmouth 46 in the radial direction relative to the rotation axis RS when viewed from an angle parallel with the rotation axis RS is defined as an outer circumferential region 12R. It is desirable that the impeller 10 be configured such that in the outer circumferential region 12R, too, the ratio of the first turbo blade portion 12A2 is larger than the ratio of the first sirocco blade portion 12A1. That is, in the outer circumferential region 12R of the impeller 10 situated closer to the outer circumference than the inside diameter BI of the bellmouth 46 when viewed from an angle parallel with the rotation axis RS, a first turbo region 12A21*a* is larger than the first sirocco region 12A11 in the radial direction relative to the rotation axis RS. The first turbo region 12A21*a* is a region of the first turbo region 12A21 situated closer to the outer circumference than the inside diameter BI of the bellmouth 46 when viewed from an angle parallel with the rotation axis RS. Moreover, in a case in which a first turbo blade portion 12A2 forming the first turbo region 12A21*a* is a first turbo blade portion 12A2*a*, it is desirable that the outer circumferential region 12R of the impeller 10 be configured such that a ratio of the first turbo blade portion 12A2*a* is larger than the ratio of the first sirocco blade portion 12A1. The relationship between the ratio of the first sirocco blade portion 12A1 and the ratio of the first turbo blade portion 12A2*a* in the outer circumferential region 12R holds in both the backing-plate-side blade region 122*a* serving as the first region and the rim-side blade region 122*b* serving as the second region.

Similarly, the impeller 10 is configured such that the second turbo region 12B21 is larger than the second sirocco region 12B11 in the radial direction relative to the rotation axis RS. That is, the impeller 10 and each of the second blades 12B are configured such that the ratio of the second turbo blade portion 12B2 is larger than the ratio of the second sirocco blade portion 12B1 in the radial direction relative to the rotation axis RS, and have the relationship "Second Sirocco Blade Portion 12B1<Second Turbo Blade Portion 12B2". The relationship between the ratio of the second sirocco blade portion 12B1 and the ratio of the second turbo blade portion 12B2 in the radial direction of the rotation axis RS holds in both the backing-plate-side blade region 122*a* serving as the first region and the rim-side blade region 122*b* serving as the second region.

Furthermore, it is desirable that the impeller 10 be configured such that in the outer circumferential region 12R, too, the ratio of the second turbo blade portion 12B2 is larger than the ratio of the second sirocco blade portion 12B1. That is, in the outer circumferential region 12R of the impeller 10 situated closer to the outer circumference than the inside diameter BI of the bellmouth 46 when viewed from an angle parallel with the rotation axis RS, a second turbo region 12B21*a* is larger than the second sirocco region 12B11 in the radial direction relative to the rotation axis RS. The second turbo region 12B21*a* is a region of the second turbo region 12B21 situated closer to the outer circumference than the inside diameter BI of the bellmouth 46 when viewed from an angle parallel with the rotation axis RS. Moreover, in a case in which a second turbo blade portion 12B2 forming the second turbo region 12B21*a* is a second turbo blade portion 12B2*a*, it is desirable that the outer circumferential region 12R of the impeller 10 be configured such that a ratio of the second turbo blade portion 12B2*a* is larger than the ratio of the second sirocco blade portion 12B1. The relationship between the ratio of the second sirocco blade portion 12B1 and the ratio of the second turbo blade portion 12B2*a* in the outer circumferential region 12R holds in both the backing-plate-side blade region 122*a* serving as the first region and the rim-side blade region 122*b* serving as the second region.

Figure 10:
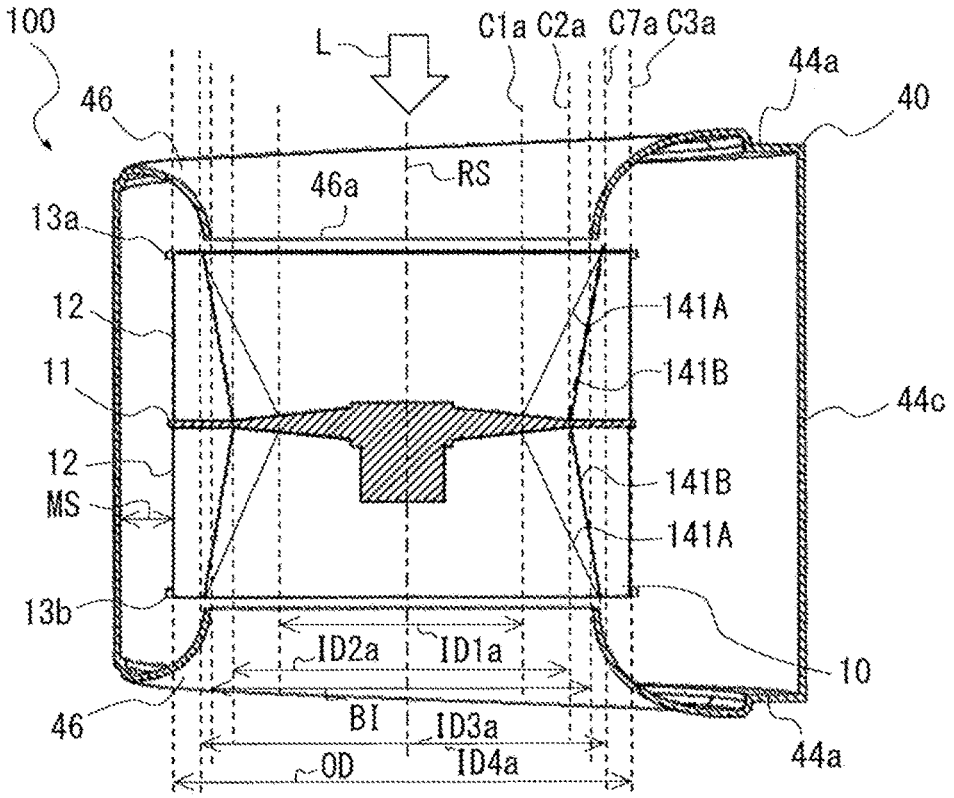
FIG. 10 is a schematic view illustrating a relationship between the impeller and the bellmouths in the cross-section of the multi-blade air-sending device as taken along line A-A in FIG. 2.
Figure 11:
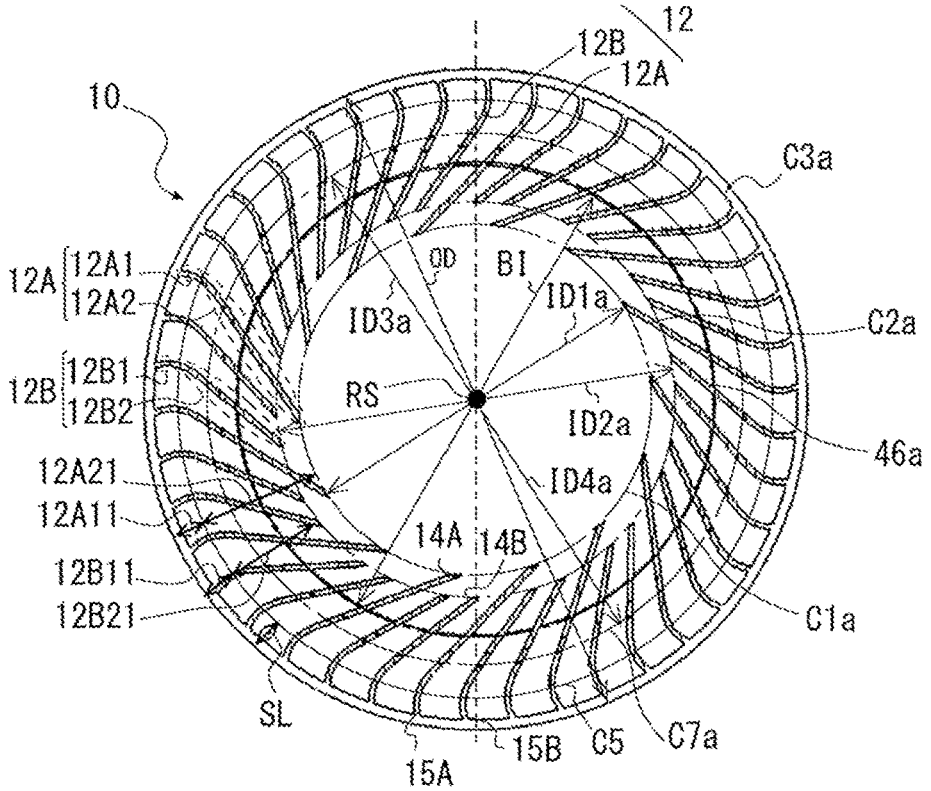
FIG. 11 is a schematic view illustrating a relationship between the blades and a bellmouth as viewed from an angle parallel with the rotation axis in the impeller in FIG. 10.

FIG. 10 is a schematic view illustrating a relationship between the impeller 10 and the bellmouths 46 in the cross-section of the multi-blade air-sending device 100 as taken along line A-A in FIG. 2. FIG. 11 is a schematic view illustrating a relationship between the blades 12 and a bellmouth 46 as viewed from an angle in parallel with the rotation axis RS in the impeller 10 in FIG. 10. In FIG. 10, the outline arrow L indicates a direction from which the impeller 10 is viewed parallel with the rotation axis RS. As shown in FIGS. 10 and 11, a circle passing through the inner circumferential ends 14A of the plurality of first blades 12A around the rotation axis RS at connecting locations between the first blades 12A and the backing plate 11 when viewed from an angle parallel with the rotation axis RS is defined as a circle Cia. Moreover, the diameter of the circle Cia, that is, the inside diameter of the first blades 12A at the connecting locations between the first blades 12A and the backing plate 11, is assumed to be an inside diameter ID1*a*. Further, a circle passing through the inner circumferential ends 14B of the plurality of second blades 12B around the rotation axis RS at connecting locations between the second blades 12B and the backing plate 11 when viewed from an angle parallel with the rotation axis RS is defined as a circle C2*a*. Moreover, the diameter of the circle C2*a*, that is, the inside diameter of the second blades 12B at the connecting locations between the second blades 12B and the backing plate 11, is assumed to be an inside diameter ID2*a*. The inside diameter ID2*a* is larger than the inside diameter ID1*a* (Inside Diameter ID2*a*>Inside Diameter ID1*a*). Further, the diameter of a circle C3*a* passing through the outer circumferential ends 15A of the plurality of first blades 12A and the outer circumferential ends 15B of the plurality of second blades 12B around the rotation axis RS when viewed from an angle parallel with the rotation axis RS, that is, the outside diameter of the plurality of blades 12, is assumed to be a blade outside diameter OD. Further, a circle passing through the inner circumferential ends 14A of the plurality of first blades 12A around the rotation axis RS at connecting locations between the first blades 12A and the rim 13 when viewed from an angle parallel with the rotation axis RS is defined as a circle C7*a*. Moreover, the diameter of the circle C7*a*, that is, the inside diameter of the first blades 12A at the connecting locations between the first blades 12A and the rim 13, is assumed to be an inside diameter ID3*a*. Further, a circle passing through the inner circumferential ends 14B of the plurality of second blades 12B around the rotation axis RS at connecting locations between the second blades 12B and the rim 13 when viewed from an angle parallel with the rotation axis RS is the circle C7*a*. Moreover, the diameter of the circle C7*a*, that is, the inside diameter of the second blades 12B at the connecting locations between the second blades 12B and the rim 13, is assumed to be an inside diameter ID4*a*.

As shown in FIGS. 10 and 11, the inside diameter BI of the bellmouth 46 is located in a region of the first turbo blade portions 12A2 and the second turbo blade portions 12B2 between the inside diameter ID1*a* of the first blades 12A beside the backing plate 11 and the inside diameter ID3*a* of the first blades 12A beside the rim 13. More specifically, the inside diameter BI of the bellmouth 46 is larger than the inside diameter ID1*a* of the first blades 12A beside the backing plate 11 and smaller than the inside diameter ID3*a* of the first blades 12A beside the rim 13. That is, the inside diameter BI of the bellmouth 46 is formed to be larger than the blade inside diameter of the plurality of blades 12 beside the backing plate 11 and smaller than the blade inside diameter of the plurality of blades 12 beside the rim 13. In other words, an opening 46*a* forming the inside diameter BI of the bellmouth 46 is located in a region of the first turbo blade portions 12A2 and the second turbo blade portions 12B2 between the circle Cia and the circle C7*a* when viewed from an angle parallel with the rotation axis RS.

Further, as shown in FIGS. 10 and 11, the inside diameter BI of the bellmouth 46 is located in a region of the first turbo blade portions 12A2 and the second turbo blade portions 12B2 between the inside diameter ID2*a* of the second blades 12B beside the backing plate 11 and the inside diameter ID4*a* of the second blades 12B beside the rim 13. More specifically, the inside diameter BI of the bellmouth 46 is larger than the inside diameter ID2*a* of the second blades 12B beside the backing plate 11 and smaller than the inside diameter ID4*a* of the second blades 12B beside the rim 13. That is, the inside diameter BI of the bellmouth 46 is formed to be larger than the blade inside diameter of the plurality of blades 12 beside the backing plate 11 and smaller than the blade inside diameter of the plurality of blades 12 beside the rim 13. More specifically, the inside diameter BI of the bellmouth 46 is formed to be larger than a blade inside diameter formed by the inner circumferential end of each of the plurality of blades 12 in the first region and smaller than a blade inside diameter formed by the inner circumferential end of each of the plurality of blades 12 in the second region. In other words, the opening 46*a* forming the inside diameter BI of the bellmouth 46 is located in a region of the first turbo blade portions 12A2 and the second turbo blade portions 12B2 between the circle C2*a* and the circle C7*a* when viewed from an angle parallel with the rotation axis RS.

Let it be assumed that as shown in FIGS. 10 and 11, in the radial direction of the impeller 10, a radial length of each of the first and second sirocco blade portions 12A1 and 12B1 is a distance SL. Further, in the multi-blade air-sending device 100, the shortest distance between the plurality of blades 12 of the impeller 10 and the peripheral wall 44*c* of the scroll casing 40 is assumed to be a distance MS. In this case, the multi-blade air-sending device 100 is configured such that the distance MS is more than twice as long as the distance SL (Distance MS>Distance SL×2). Although the distance MS is shown in the A-A section of the multi-blade air-sending device 100 in FIG. 10, the distance MS is the shortest distance from the peripheral wall 44*c* of the scroll casing 40 and is not necessarily shown on the A-A section.

Figure 12:
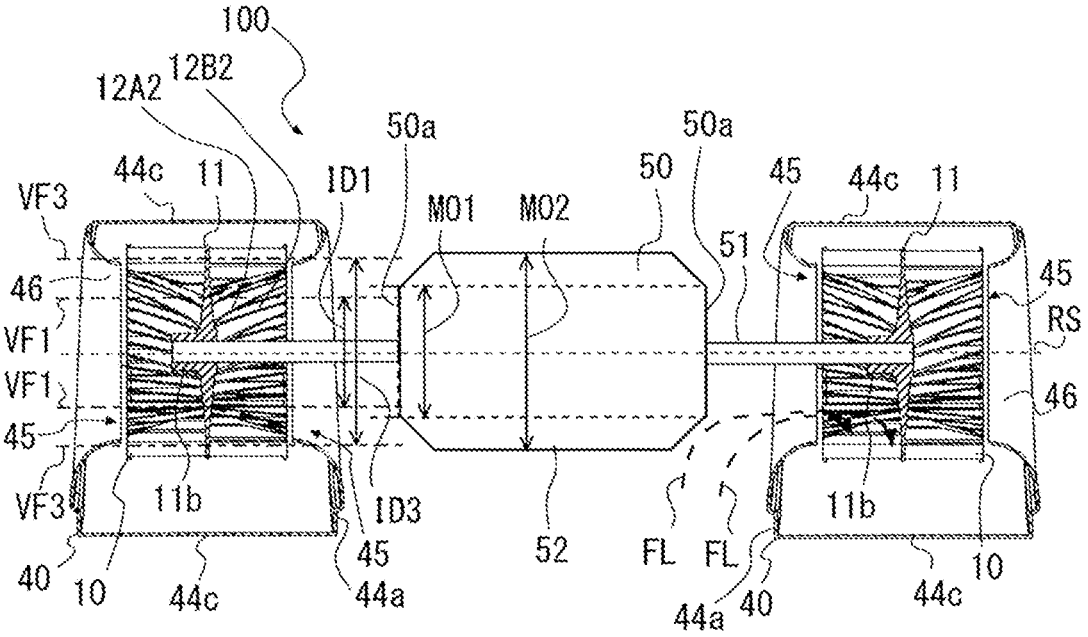
FIG. 12 is a conceptual diagram explaining a relationship between the impeller and a motor in the multi-blade air-sending device according to Embodiment 1.

FIG. 12 is a conceptual diagram explaining a relationship between the impeller 10 and a motor 50 in the multi-blade air-sending device 100 according to Embodiment 1. In FIG. 12, the dotted lines FL indicate a flow of air flowing from outside into the scroll casing 40. As shown in FIG. 12, the multi-blade air-sending device 100 may have, in addition to the impeller 10 and the scroll casing 40, a motor 50 configured to rotate the backing plate 11 of the impeller 10. That is, the multi-blade air-sending device 100 may have an impeller 10, a scroll casing 40 housing the impeller 10, and a motor 50 configured to drive the impeller 10.

The motor 50 is disposed adjacent to the side wall 44*a* of the scroll casing 40. The motor 50 has a motor shaft 51 extending on the rotation axis RS of the impeller 10 and being inserted in the scroll casing 40 through a side surface of the scroll casing 40.

The backing plate 11 is disposed so as to be perpendicular to the rotation axis RS along the side wall 44*a* of the scroll casing 40 facing the motor 50. The backing plate 11 has provided in a central part thereof a shaft portion 11*b* with which the motor shaft 51 is connected, and the motor shaft 51 is fixed to the shaft portion 11*b* of the backing plate 11 while being inserted in the scroll casing 40. The motor shaft 51 of the motor 50 is connected with the backing plate 11 of the impeller 10 to be fixed.

Once the motor 50 is brought into operation, the plurality of blades 12 rotate around the rotation axis RS via the motor shaft 51 and the backing plate 11. This causes outside air to be suctioned into the impeller 10 through the air inlet 45 and blown out into the scroll casing 40 by a booster action of the impeller 10. The air blown out into the scroll casing 40 recovers its static pressure by having its speed reduced in an expanded air trunk formed by the peripheral wall 44*c* of the scroll casing 40, and is blown out to the outside through the discharge port 42*a* shown in FIG. 1.

As shown in FIG. 12, an outer peripheral wall 52 forming the outside diameter MO1 of an end portion 50*a* of the motor 50 is located between a virtual extended surface VF1 formed by extending the blade inside diameter of the blades 12 beside the backing plate 11 in the axial direction of the rotation axis RS and a virtual extended surface VF3 formed by extending the blade inside diameter of the blades 12 beside the rim 13 in the axial direction of the rotation axis RS. Further, the outer peripheral wall 52 forming the outside diameter MO1 of the end portion 50*a* of the motor 50 is disposed in such a location as to face the first turbo blade portions 12A2 and the second turbo blade portions 12B2 in the axial direction of the rotation axis RS. More specifically, the outside diameter MO1 of the end portion 50*a* of the motor 50 is larger than the inside diameter ID1 of the plurality of first blades 12A beside the backing plate 11 and smaller than the inside diameter ID3 of the plurality of first blades 12A beside the rim 13. That is, the outside diameter MO1 of the end portion 50*a* of the motor 50 is formed to be larger than the blade inside diameter of the plurality of blades 12 beside the backing plate 11 and smaller than the blade inside diameter of the plurality of blades 12 beside the rim 13. Further, the outer peripheral wall 52 at the end portion 50*a* of the motor 50 is located in a region of the first turbo blade portions 12A2 and the second turbo blade portions 12B2 between the aforementioned circles C1*a* and C7*a* when viewed from an angle parallel with the rotation axis RS. In the multi-blade air-sending device 100, as for a dimension of the outside diameter MO2 of a portion of the motor 50 other than the end portion 50*a*, a size of the outside diameter MO2 is not limited.

Figure 13:
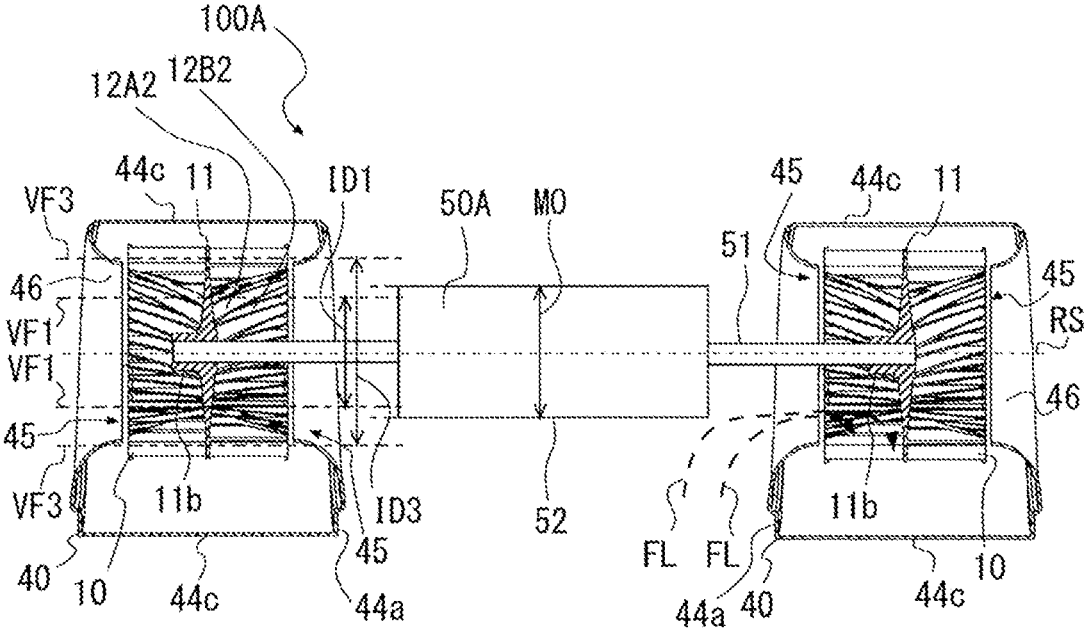
FIG. 13 is a conceptual diagram of a multi-blade air-sending device according to a first modification of the multi-blade air-sending device shown in FIG. 12.

FIG. 13 is a conceptual diagram of a multi-blade air-sending device 100A according to a first modification of the multi-blade air-sending device 100 shown in FIG. 12. The multi-blade air-sending device 100A is configured such that an outer peripheral wall 52 forming the outside diameter MO of a motor 50A is located between a virtual extended surface VF1 formed by extending the blade inside diameter of the blades 12 beside the backing plate 11 in the axial direction of the rotation axis RS and a virtual extended surface VF3 formed by extending the blade inside diameter of the blades 12 beside the rim 13 in the axial direction of the rotation axis RS. Further, the outer peripheral wall 52 forming the outside diameter MO of the motor 50A is disposed in such a location as to face the first turbo blade portions 12A2 and the second turbo blade portions 12B2 in the axial direction of the rotation axis RS. More specifically, the outside diameter MO of the motor 50A is larger than the inside diameter ID1 of the plurality of first blades 12A beside the backing plate 11 and smaller than the inside diameter ID3 of the plurality of first blades 12A beside the rim 13. That is, the outside diameter MO of the motor 50A is formed to be larger than the blade inside diameter of the plurality of blades 12 beside the backing plate 11 and smaller than the blade inside diameter of the plurality of blades 12 beside the rim 13. Further, the outer peripheral wall 52 forming the outside diameter MO of the motor 50A is located in a region of the first turbo blade portions 12A2 and the second turbo blade portions 12B2 between the aforementioned circles Cia and C7*a* when viewed from an angle parallel with the rotation axis RS.

Figure 14:
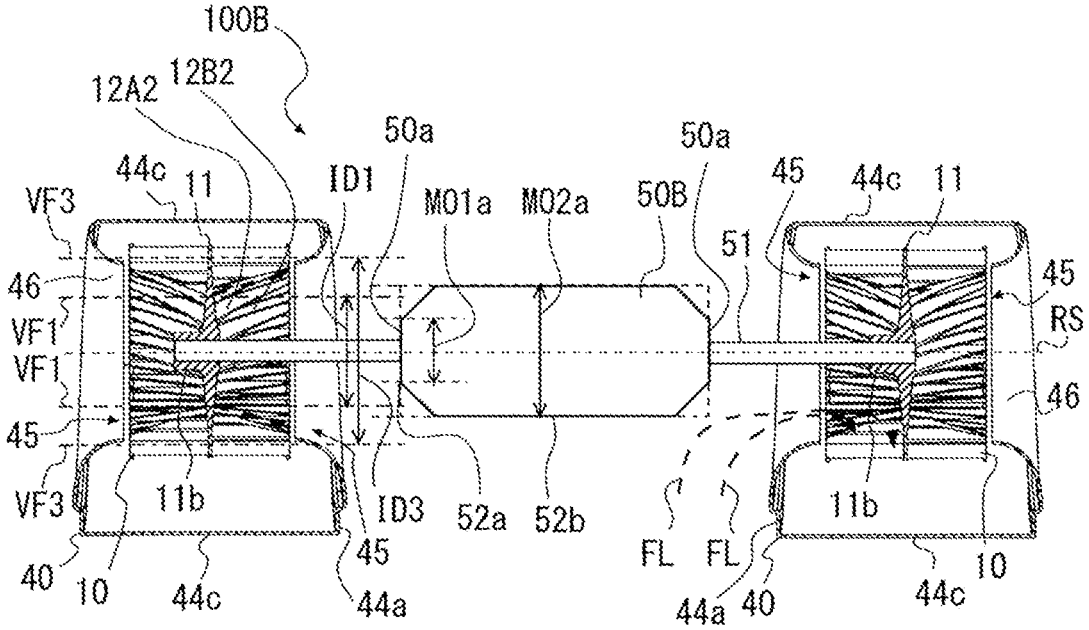
FIG. 14 is a conceptual diagram of a multi-blade air-sending device according to a second modification of the multi-blade air-sending device shown in FIG. 12.

FIG. 14 is a conceptual diagram of a multi-blade air-sending device 100B according to a second modification of the multi-blade air-sending device 100 shown in FIG. 12. As shown in FIG. 14, an outer peripheral wall 52*a* forming the outside diameter MO1*a* of an end portion 50*a* of a motor 50B is located between the rotation axis RS and a virtual extended surface VF1 formed by extending the blade inside diameter of the blades 12 beside the backing plate 11 in the axial direction of the rotation axis RS. Further, the outer peripheral wall 52*a* forming the outside diameter MO1*a* of the end portion 50*a* of the motor 50B is disposed in such a location as to face the first turbo blade portions 12A2 and the second turbo blade portions 12B2 in the axial direction of the rotation axis RS. More specifically, the outside diameter MO1*a* of the end portion 50*a* of the motor 50B is smaller than the inside diameter ID1 of the plurality of first blades 12A beside the backing plate 11. That is, the outside diameter MO1*a* of the end portion 50*a* of the motor 50B is formed to be smaller than the blade inside diameter of the plurality of blades 12 beside the backing plate 11. Further, the outer peripheral wall 52*a* at the end portion 50*a* of the motor 50B is located within the aforementioned circle C1*a* when viewed from an angle parallel with the rotation axis RS.

Further, the multi-blade air-sending device 100B is configured such that an outer peripheral wall 52*b* forming the outermost diameter MO2*a* of the motor 50B is located between the virtual extended surface VF1 formed by extending the blade inside diameter of the blades 12 beside the backing plate 11 in the axial direction of the rotation axis RS and a virtual extended surface VF3 formed by extending the blade inside diameter of the blades 12 beside the rim 13 in the axial direction of the rotation axis RS. Further, the outer peripheral wall 52*b* forming the outermost diameter MO2*a* of the motor 50B is disposed in such a location as to face the first turbo blade portions 12A2 and the second turbo blade portions 12B2 in the axial direction of the rotation axis RS. More specifically, the outermost diameter MO2*a* of the motor 50B is larger than the inside diameter ID1 of the plurality of first blades 12A beside the backing plate 11 and smaller than the inside diameter ID3 of the plurality of first blades 12A beside the rim 13. That is, the outermost diameter MO2*a* of the motor 50B is formed to be larger than the blade inside diameter of the plurality of blades 12 beside the backing plate 11 and smaller than the blade inside diameter of the plurality of blades 12 beside the rim 13. Further, the outer peripheral wall 52*b* forming the outermost diameter MO2*a* of the motor 50B is located in a region of the first turbo blade portions 12A2 and the second turbo blade portions 12B2 between the aforementioned circles Cia and C7*a* when viewed from an angle parallel with the rotation axis RS.

[Working Effects of Impeller 10 and Multi-Blade Air-Sending Device 100]

The impeller 10 and the multi-blade air-sending device 100 are configured such that in the first and second regions of the impeller 10, a ratio of the turbo blade portion in the radial direction is larger than a ratio of the sirocco blade portion in the radial direction. Since the impeller 10 and the multi-blade air-sending device 100 are configured such that the ratio of the turbo blade portion is high in any region between the backing plate 11 and the rim 13, sufficient pressure recovery can be achieved through the plurality of blades 12. Therefore, the impeller 10 and the multi-blade air-sending device 100 can better improve pressure recovery than an impeller or a multi-blade air-sending device that does not include such a configuration. As a result, the impeller 10 can improve the efficiency of the multi-blade air-sending device 100. Furthermore, by including the foregoing configuration, the impeller 10 can reduce leading edge separation of a flow of gas beside the rim 13.

Further, each of the plurality of blades 12 has a radial blade portion serving a portion of connection between the turbo blade portion and the sirocco blade portion and having a blade angle of 90 degrees. By having the radial blade portion between the turbo blade portion and the sirocco blade portion, the impeller 10 is free of an abrupt angle change in the portion of connection between the sirocco blade portion and the turbo blade portion. Therefore, the impeller 10 can reduce pressure fluctuations in the scroll casing 40, increase the fan efficiency of the multi-blade air-sending device 100, and further reduce noise.

Further, the plurality of blades 12 are configured such that at least one of the plurality of second blades 12B is disposed between two of the plurality of first blades 12A adjacent to each other in the circumferential direction. Since the impeller 10 and the multi-blade air-sending device 100 are configured such that in each of the second blades 12B, too, the ratio of the turbo blade portion is high in any region between the backing plate 11 and the rim 13, sufficient pressure recovery can be achieved through the second blades 12B. Therefore, the impeller 10 and the multi-blade air-sending device 100 can better improve pressure recovery than an impeller or a multi-blade air-sending device that does not include such a configuration. As a result, the impeller 10 can improve the efficiency of the multi-blade air-sending device 100. Furthermore, by including the foregoing configuration, the impeller 10 can reduce leading edge separation of a flow of gas beside the rim 13.

Further, the plurality of second blades 12B are formed such that a ratio of an inside diameter formed by the inner circumferential end 14B of each of the plurality of second blades 12B to an outside diameter formed by the outer circumferential end 15B of each of the plurality of second blades 12B is lower than or equal to 0.7. Since the impeller 10 and the multi-blade air-sending device 100 are configured such that in each of the second blades 12B, too, the ratio of the turbo blade portion is high in any region between the backing plate 11 and the rim 13, sufficient pressure recovery can be achieved through the second blades 12B. Therefore, the impeller 10 and the multi-blade air-sending device 100 can better improve pressure recovery than an impeller or a multi-blade air-sending device that does not include such a configuration. As a result, the impeller 10 can improve the efficiency of the multi-blade air-sending device 100. Furthermore, by including the foregoing configuration, the impeller 10 can reduce leading edge separation of a flow of gas beside the rim 13.

Further, the plurality of blades 12 are configured such that in a portion of the plurality of blades 12 situated closer to the outside than the inside diameter BI of the bellmouth 46 in the radial direction relative to the rotation axis RS, a ratio of a region of the turbo blade portion in the radial direction of the backing plate 11 is larger than a ratio of a region of the sirocco blade portion in the radial direction of the backing plate 11. The plurality of blades 12 is configured such that such a configuration holds in any region between the backing plate 11 and the rim 13. By including such a configuration, the plurality of blades 12 can increase the amount of air that is suctioned in a portion of the blades 12 inside the inside diameter BI of the bellmouth 46. Further, by increasing the ratio of the turbo blade portion in the portion of the plurality of blades 12 situated closer to the outside than the inside diameter BI of the bellmouth 46, the plurality of blades 12 can increase the volume of air that is emitted from the impeller 10. Furthermore, by having such a configuration, the plurality of blades 12 can increase pressure recovery in the scroll casing 40 of the multi-blade air-sending device 100 and improve fan efficiency.

Further, the inside diameter BI of the bellmouth 46 is formed to be larger than the blade inside diameter of the plurality of blades 12 beside the backing plate 11 and smaller than the blade inside diameter of the plurality of blades 12 beside the rim 13. Therefore, the multi-blade air-sending device 100 can reduce interference between a flow of suctioned gas flowing in through the air inlet 45 of the bellmouth 46 and the blades 12 beside the rim 13 and further reduce noise.

Further, the inside diameter BI of the bellmouth 46 is formed to be larger than the blade inside diameter of the plurality of second blades 12B beside the backing plate 11 and smaller than the blade inside diameter of the plurality of second blades 12B beside the rim 13. Therefore, the multi-blade air-sending device 100 can reduce interference between a flow of suctioned gas flowing in through the air inlet 45 of the bellmouth 46 and the second blades 12B beside the rim 13 and further reduce noise.

Further, the distance MS, which is the shortest distance between the plurality of blades 12 and the peripheral wall 44*c*, is more than twice as long as the radial length of the sirocco blade portion. Therefore, the multi-blade air-sending device 100 can achieve pressure recovery through the turbo blade portion, increase the distance between the scroll casing 40 and the impeller 10 in a place where they are closest to each other, and can therefore reduce noise.

Further, the multi-blade air-sending device 100 is formed such that the outside diameter MO1 of an end portion 50*a* of the motor 50 is larger than the blade inside diameter of the plurality of blades 12 beside the backing plate 11 and smaller than the blade inside diameter of the plurality of blades 12 beside the rim 13. By including such a configuration, the multi-blade air-sending device 100 causes a flow of gas from the vicinity of the motor 50 to be diverted into the axial direction of the rotation axis RS of the impeller 10 and causes air to be smoothly flow into the scroll casing 40, thereby making it possible to increase the volume of air that is emitted from the impeller 10. Furthermore, by having such a configuration, the multi-blade air-sending device 100 can increase pressure recovery in the scroll casing 40 and improve fan efficiency.

Further, the multi-blade air-sending device 100A is formed such that the outside diameter MO of the motor 50A is larger than the blade inside diameter of the plurality of blades 12 beside the backing plate 11 and smaller than the blade inside diameter of the plurality of blades 12 beside the rim 13. By including such a configuration, the multi-blade air-sending device 100A causes a flow of gas from the vicinity of the motor 50A to be diverted into the axial direction of the rotation axis RS of the impeller 10 and causes air to be smoothly flow into the scroll casing 40, thereby making it possible to increase the volume of air that is emitted from the impeller 10. Furthermore, by having such a configuration, the multi-blade air-sending device 100A can increase pressure recovery in the scroll casing 40 and improve fan efficiency.

Further, the multi-blade air-sending device 100B is formed such that the outside diameter MO2*a* of the motor 50B is larger than the blade inside diameter of the plurality of blades 12 beside the backing plate 11 and smaller than the blade inside diameter of the plurality of blades 12 beside the rim 13 and the outside diameter MO1*a* of an end portion 50*a* of the motor 50B is formed to be smaller than the blade inside diameter of the plurality of blades 12 beside the backing plate 11. By including such a configuration, the multi-blade air-sending device 100B can better cause air to be smoothly flow into the scroll casing 40 and increase the volume of air that is emitted from the impeller 10 than the multi-blade air-sending device 100A or other devices. Furthermore, by having such a configuration, the multi-blade air-sending device 100B can better increase pressure recovery in the scroll casing 40 and improve fan efficiency than the multi-blade air-sending device 100A or other devices.

Embodiment 2

[Multi-Blade Air-Sending Device 100C]

Figure 15:
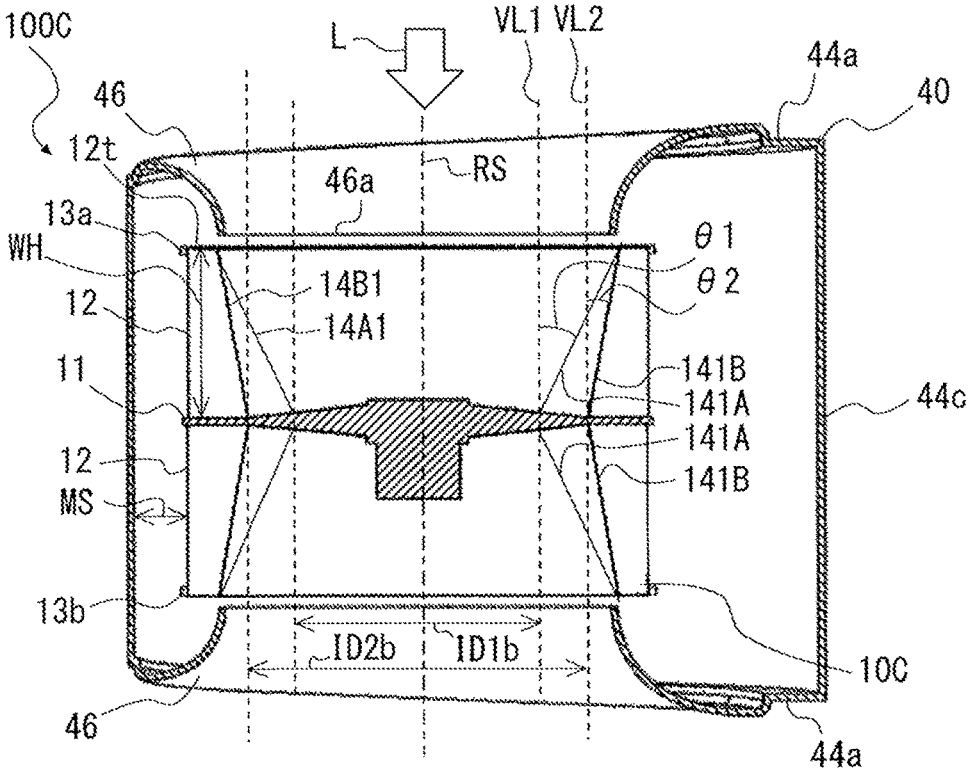
FIG. 15 is a cross-sectional view schematically illustrating a multi-blade air-sending device according to Embodiment 2.
Figure 16:
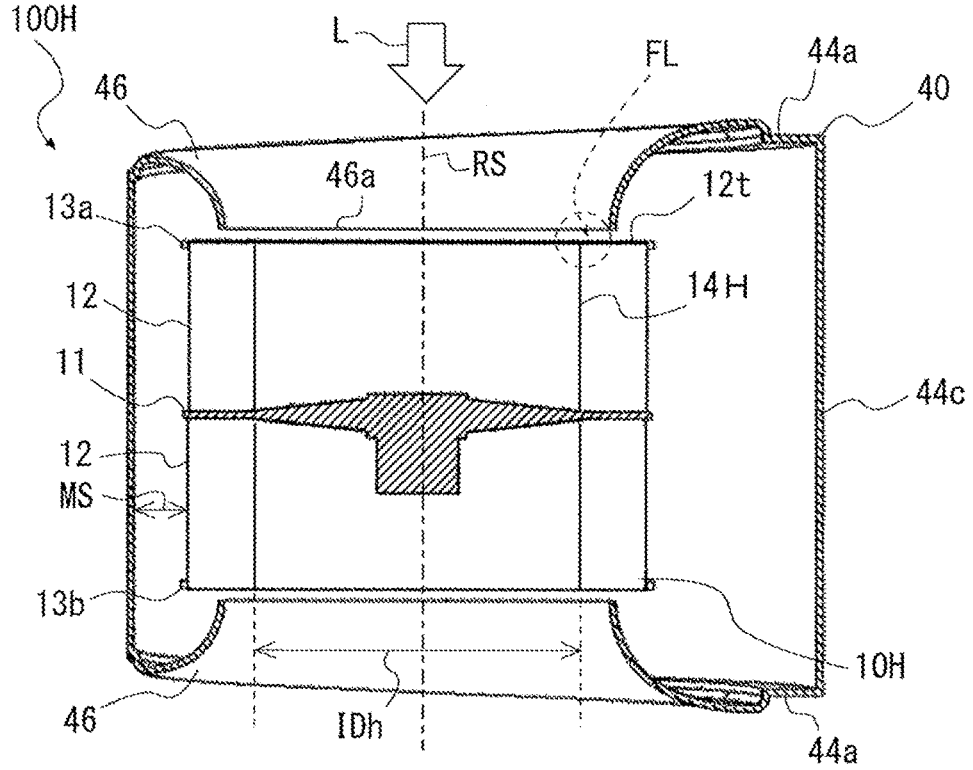
FIG. 16 is a cross-sectional view schematically illustrating a multi-blade air-sending device according to a comparative example.
Figure 17:
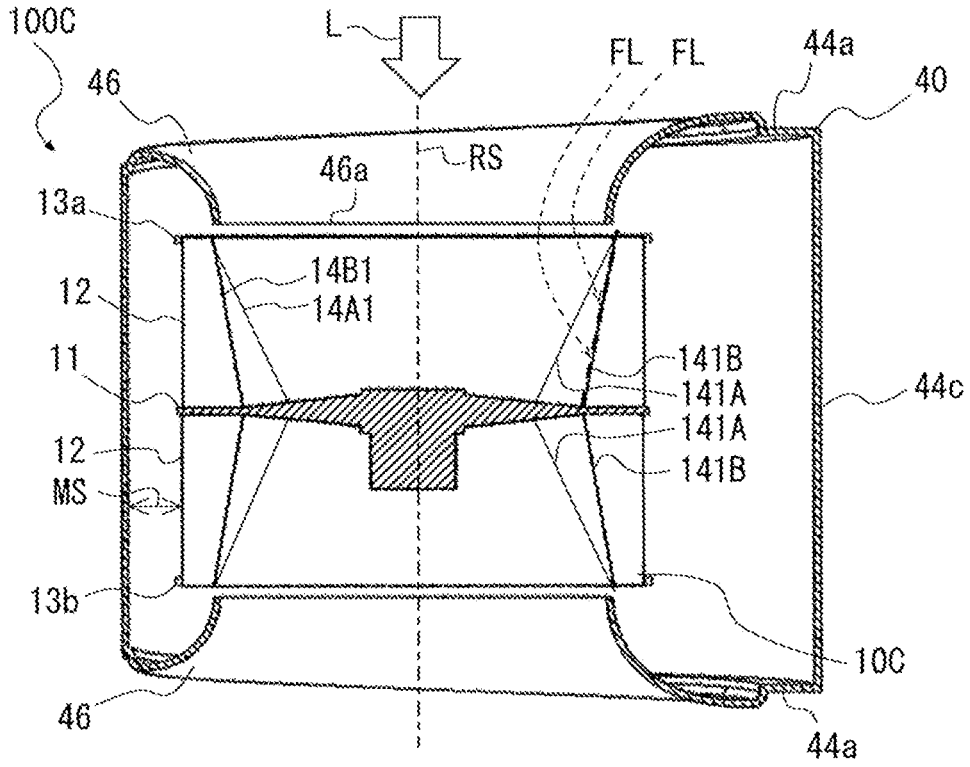
FIG. 17 is a cross-sectional view schematically illustrating the workings of the multi-blade air-sending device according to Embodiment 2.

FIG. 15 is a cross-sectional view schematically illustrating a multi-blade air-sending device 100C according to Embodiment 2. FIG. 16 is a cross-sectional view schematically illustrating a multi-blade air-sending device 100H according to a comparative example. FIG. 17 is a cross-sectional view schematically illustrating the workings of the multi-blade air-sending device 100C according to Embodiment 2. FIG. 15 is a cross-sectional view schematically illustrating effects of the multi-blade air-sending device 1000 according to Embodiment 2. The multi-blade air-sending device 1000 according to Embodiment 2 is described with reference to FIGS. 15 to 17. It should be noted that components having identical configurations as those of the multi-blade air-sending device 100 or other devices of FIGS. 1 to 14 are given identical signs and a description of such components is omitted. An impeller 10C of the multi-blade air-sending device 1000 according to Embodiment 2 is intended to further specify the configuration of the inclined portions 141A and 141B of the plurality of blades 12 of the impeller 10 of the multi-blade air-sending device 100 according to Embodiment 1. Accordingly, in the following description, the impeller 10C is described with reference to FIGS. 15 to 17 with a focus on a configuration of the inclined portions 141A and 141B of the multi-blade air-sending device 1000 according to Embodiment 2.

As mentioned above, the plurality of blades 12 form an inclined portion 141A inclined such that the leading edges 14A1 extend away from the rotation axis RS so that the blade inside diameter increases from the backing plate 11 toward the rim 13. That is, the plurality of blades 12 form an inclined portion 141A inclined such that the inner circumferential ends 14A extend away from the rotation axis RS so that the blade inside diameter increases from the backing plate 11 toward the rim 13. Similarly, the plurality of blades 12 form an inclined portion 141B inclined such that the leading edges 14B1 extend away from the rotation axis RS so that the blade inside diameter increases from the backing plate 11 toward the rim 13. That is, the plurality of blades 12 form an inclined portion 141B inclined such that the inner circumferential ends 14B extend away from the rotation axis RS so that the blade inside diameter increases from the backing plate 11 toward the rim 13. The plurality of blades 12 have gradients formed on the inner circumference by the inclined portion 141A and the inclined portion 141B.

The inclined portion 141A is inclined relative to the rotation axis RS. The inclined portion 141A has an angle of inclination preferably larger than 0 degree and smaller than or equal to 60 degrees or more preferably larger than 0 degree and smaller than or equal to 45 degrees. That is, an angle of inclination θ1 between the inclined portion 141A and the rotation axis RS is configured to preferably satisfy the relationship "0 degree<θ1≤60 degrees" or more preferably satisfy the relationship "0 degree<θ1≤45 degrees". In FIG. 15, the virtual line VL1 is a virtual line parallel with the rotation axis RS. Therefore, an angle between the inclined portion 141A and the virtual line VL1 is equal to the angle between the inclined portion 141A and the rotation axis RS.

Similarly, the inclined portion 141B is inclined relative to the rotation axis RS. The inclined portion 141B has an angle of inclination preferably larger than 0 degree and smaller than or equal to 60 degrees or more preferably larger than 0 degree and smaller than or equal to 45 degrees. That is, an angle of inclination θ2 between the inclined portion 141B and the rotation axis RS is configured to preferably satisfy the relationship "0 degree<θ2≤60 degrees" or more preferably satisfy the relationship "0 degree<θ2≤45 degrees". In FIG. 15, the virtual line VL2 is a virtual line parallel with the rotation axis RS. Therefore, an angle between the inclined portion 141B and the virtual line VL2 is equal to the angle between the inclined portion 141B and the rotation axis RS. The angle of inclination θ1 and the angle of inclination θ2 may be the same as or different from each other.

The blade height WH shown in FIG. 15 is less than or equal to 200 mm. The blade height WH is the distance between the backing plate 11 and end portions 12*t* of the plurality of blades 12 in the axial direction of the rotation axis RS, and is the maximum distance between the backing plate 11 and the end portions 12*t* of the plurality of blades 12 in the axial direction of the rotation axis RS. The blade height WH is not limited to being less than or equal to 200 mm but may be greater than 200 mm.

[Working Effects of Impeller 10C and Multi-Blade Air-Sending Device 100C]

As shown in FIG. 16, the multi-blade air-sending device 100H according to the comparative example is configured such that an inside diameter IDh formed by the leading edges 14H has a certain size in the axial direction of the rotation axis RS. That is, the multi-blade air-sending device 100H according to the comparative example does not have an inclined portion 141A or an inclined portion 141B, and therefore does not have a gradient formed in the blade inside diameter. Therefore, as shown in FIG. 16, the multi-blade air-sending device 100H according to the comparative example is configured such that air (dotted line FL) to be suctioned into the multi-blade air-sending device 100H easily passes through an end portion 12*t* of the impeller 10H or a corner portion formed by the end portion 12*t* and a leading edge 14H. The end portion 12*t* of the impeller 10H or the corner portion formed by the end portion 12*t* and the leading edge 14H is a portion of the blade 12 that is small in area. Therefore, the air passes through a narrow gap between the blade 12 and an adjacent blade 12, so that the multi-blade air-sending device 100H suctions the air with high ventilation resistance.

On the other hand, as shown in FIG. 17, the multi-blade air-sending device 100C has an inclined portion 141A and an inclined portion 141B at the leading edges of the blades 12, and has a gradient formed in the blade inside diameter. Therefore, as shown in FIG. 17, the gradient formed in the blade inside diameter of the blades 12 allows the multi-blade air-sending device 100C to ensure a wide area of the leading edges of the blades 12 relative to a flow of gas, so that air can pass through the impeller 10C with low ventilation resistance. As a result, the multi-blade air-sending device 100C can increase air-sending efficiency.

Angles of inclination of the inclined portions 141A and 141B of the multi-blade air-sending device 1000 may be set as appropriate. Although increasing the angles of inclination of the inclined portions 141A and 141B makes it possible to ensure a wide area of the leading edges of the blades 12 relative to a flow of gas, it is necessary to increase the sizes of the impeller 10C and the multi-blade air-sending device 100C in the radial direction to increase the angles of inclination while ensuring the predetermined blade height WH. To ensure a wide area of the leading edges of the blades 12 while suppressing upsizing of the impeller 10C and the multi-blade air-sending device 100C, it is desirable to set the angles of inclination of the inclined portions 141A and 141B to be smaller than or equal to 60 degrees. Further, to achieve a further reduction in size of the impeller 10C and the multi-blade air-sending device 100C, it is desirable to set the angles of inclination of the inclined portions 141A and 141B to be smaller than or equal to 45 degrees.

[Multi-Blade Air-Sending Device 100D]

Figure 18:
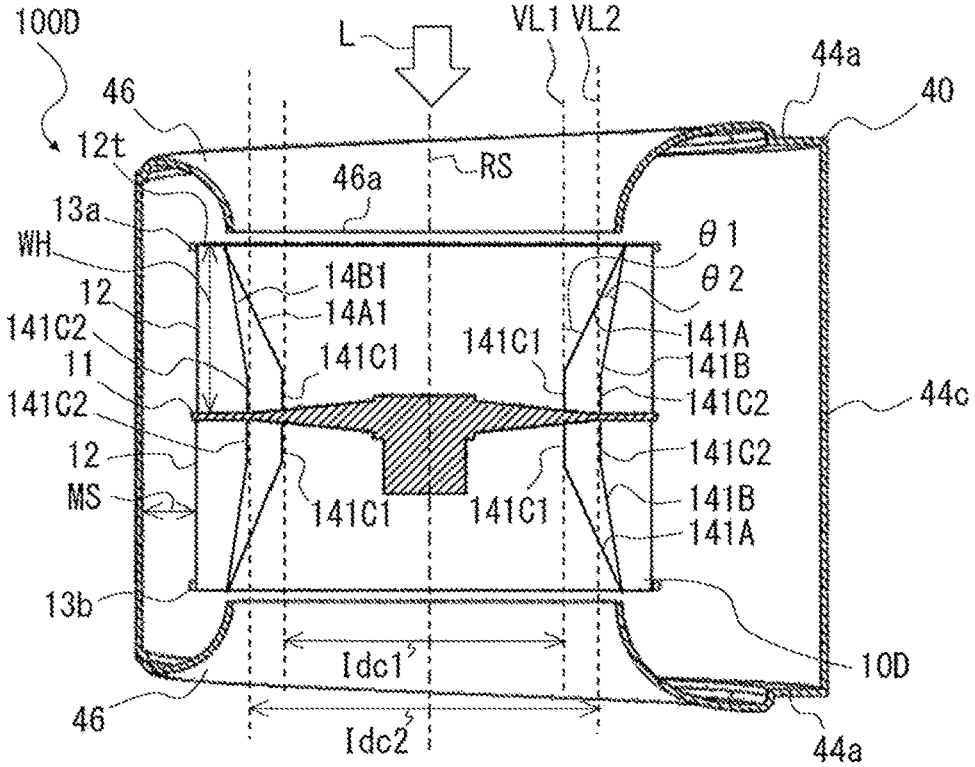
FIG. 18 is a cross-sectional view of a multi-blade air-sending device according to a first modification of the multi-blade air-sending device shown in FIG. 15.

FIG. 18 is a cross-sectional view of a multi-blade air-sending device 100D according to a first modification of the multi-blade air-sending device 100C shown in FIG. 15. The multi-blade air-sending device 100D according to the first modification of the multi-blade air-sending device 1000 according to Embodiment 2 is described with reference to FIG. 18. It should be noted that components having identical configurations as those of the multi-blade air-sending device 100 or other devices of FIGS. 1 to 17 are given identical signs and a description of such elements is omitted. An impeller 10D of the multi-blade air-sending device 100D is intended to further specify the configuration of the leading edges 14A1 and 14B1 of the plurality of blades 12 of the impeller 10C of the multi-blade air-sending device 1000 according to Embodiment 2. Accordingly, in the following description, the impeller 10D is described with reference to FIG. 18 with a focus on a configuration of the leading edges 14A1 and 14B1 of the multi-blade air-sending device 100D.

As mentioned above, the plurality of blades 12 form an inclined portion 141A inclined such that the leading edges 14A1 extend away from the rotation axis RS so that the blade inside diameter increases from the backing plate 11 toward the rim 13. Similarly, the plurality of blades 12 form an inclined portion 141B inclined such that the leading edges 14B1 extend away from the rotation axis RS so that the blade inside diameter increases from the backing plate 11 toward the rim 13. The plurality of blades 12 have gradients formed on the inner circumference by the inclined portion 141A and the inclined portion 141B.

The inclined portion 141A is inclined relative to the rotation axis RS. The inclined portion 141A has an angle of inclination preferably larger than 0 degree and smaller than or equal to 60 degrees or more preferably larger than 0 degree and smaller than or equal to 45 degrees. That is, an angle of inclination θ1 between the inclined portion 141A and the rotation axis RS is configured to preferably satisfy the relationship "0 degree<θ1≤60 degrees" or more preferably satisfy the relationship "0 degree<θ1≤45 degrees". Similarly, the inclined portion 141B is inclined relative to the rotation axis RS. The inclined portion 141B has an angle of inclination preferably larger than 0 degree and smaller than or equal to 60 degrees or more preferably larger than 0 degree and smaller than or equal to 45 degrees. That is, an angle of inclination θ2 between the inclined portion 141B and the rotation axis RS is configured to preferably satisfy the relationship "0 degree<θ2≤60 degrees" or more preferably satisfy the relationship "0 degree<θ2≤45 degrees".

The blade height WH shown in FIG. 18 is less than or equal to 200 mm. The blade height WH is the distance between the backing plate 11 and end portions 12*t* of the plurality of blades 12 in the axial direction of the rotation axis RS, and is the maximum distance between the backing plate 11 and the end portions 12*t* of the plurality of blades 12 in the axial direction of the rotation axis RS. The blade height WH is not limited to being less than or equal to 200 mm but may be greater than 200 mm.

The plurality of blades 12 have linear portions 141C1 provided at the leading edges 14A1 between the backing plate 11 and the rim 13. The linear portions 141C1 are provided beside the backing plate 11 between the backing plate 11 and the rim 13. Accordingly, the leading edge 14A1 of a first blade 12A is formed by a linear portion 141C1 provided beside the backing plate 11 and an inclined portion 141A provided beside the rim 13. The impeller 10D of the multi-blade air-sending device 100D is configured such that an inside diameter IDc1 formed by the linear portions 141C1 of the leading edges 14A1 has a certain size in the axial direction of the rotation axis RS.

Similarly, the plurality of blades 12 have linear portions 141C2 provided at the leading edges 14B1 between the backing plate 11 and the rim 13. The linear portions 141C2 are provided beside the backing plate 11 between the backing plate 11 and the rim 13. Accordingly, the leading edge 14B1 of a second blade 12B is formed by a linear portion 141C2 provided beside the backing plate 11 and an inclined portion 141B provided beside the rim 13. The impeller 10D of the multi-blade air-sending device 100D is configured such that an inside diameter IDc2 formed by the linear portions 141C2 of the leading edges 14B1 has a certain size in the axial direction of the rotation axis RS.

[Working Effects of Impeller 10D and Multi-Blade Air-Sending Device 100D]

As shown in FIG. 18, the multi-blade air-sending device 100D has an inclined portion 141A and an inclined portion 141B at the leading edges of the blades 12, and has a gradient formed in the blade inside diameter. Therefore, the gradient formed in the blade inside diameter of the blades 12 allows the multi-blade air-sending device 100D to ensure a wide area of the leading edges of the blades 12 relative to a flow of gas, so that air can pass through the impeller 10D with low ventilation resistance. As a result, the multi-blade air-sending device 100D can increase air-sending efficiency.

[Multi-Blade Air-Sending Device 100E]

Figure 19:
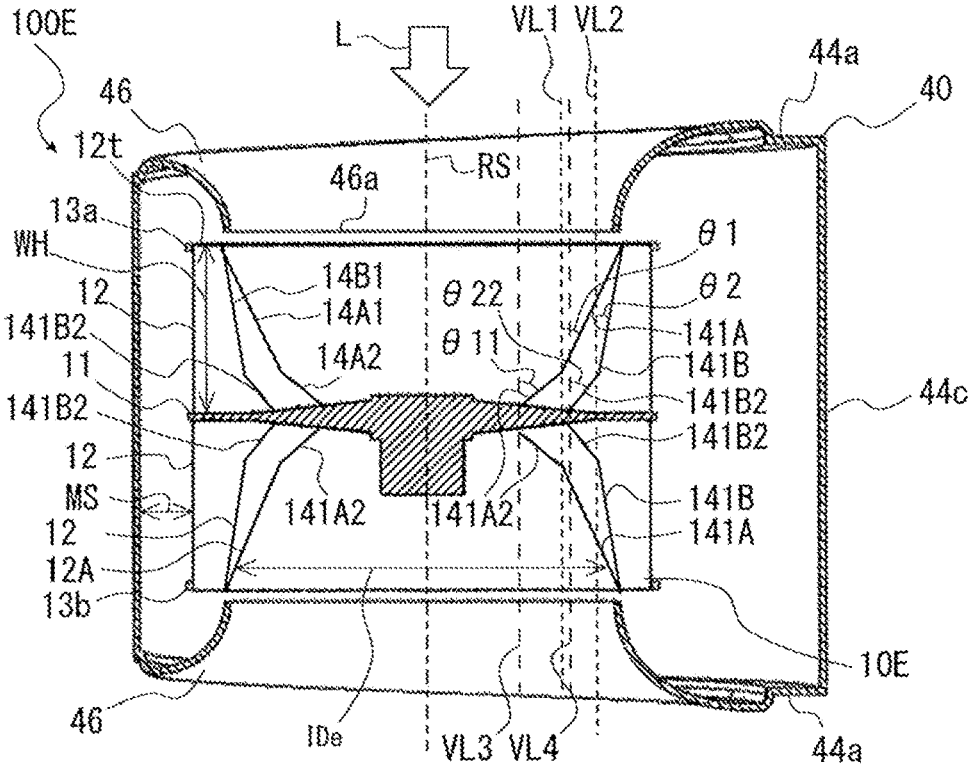
FIG. 19 is a cross-sectional view of a multi-blade air-sending device according to a second modification of the multi-blade air-sending device shown in FIG. 15.

FIG. 19 is a cross-sectional view of a multi-blade air-sending device 100E according to a second modification of the multi-blade air-sending device 100C shown in FIG. 15. The multi-blade air-sending device 100E according to the second modification of the multi-blade air-sending device 1000 according to Embodiment 2 is described with reference to FIG. 19. It should be noted that elements having identical configurations as those of the multi-blade air-sending device 100 or other devices of FIGS. 1 to 18 are given identical signs and a description of such elements is omitted. An impeller 10E of the multi-blade air-sending device 100E is intended to further specify the configuration of the leading edges 14A1 and 14B1 of the plurality of blades 12 of the impeller 10C of the multi-blade air-sending device 100C according to Embodiment 2. Accordingly, in the following description, the impeller 10E is described with reference to FIG. 19 with a focus on a configuration of the leading edges 14A1 and 14B1 of the multi-blade air-sending device 100E.

As mentioned above, the plurality of blades 12 form an inclined portion 141A inclined such that the leading edges 14A1 extend away from the rotation axis RS so that a blade inside diameter IDe increases from the backing plate 11 toward the rim 13. Further, the plurality of blades 12 form an inclined portion 141A2 inclined such that the leading edges 14A1 extend away from the rotation axis RS so that the blade inside diameter IDe increases from the backing plate 11 toward the rim 13. The inclined portion 141A2 is provided beside the backing plate 11 between the backing plate 11 and the rim 13. Accordingly, the leading edge 14A1 of a first blade 12A is formed by a inclined portion 141A2 provided beside the backing plate 11 and an inclined portion 141A provided beside the rim 13. That is, a first blade 12A of the plurality of blades 12 has two inclined portions, namely an inclined portion 141A and an inclined portion 141A2, between the backing plate 11 and the rim 13. A first blade 12A of the plurality of blades 12 is not limited to being configured to have two inclined portions, namely an inclined portion 141A and an inclined portion 141A2, but needs only have two or more inclined portions.

Similarly, the plurality of blades 12 form an inclined portion 141B inclined such that the leading edges 14B1 extend away from the rotation axis RS so that the blade inside diameter IDe increases from the backing plate 11 toward the rim 13. Further, the plurality of blades 12 form an inclined portion 141B2 inclined such that the leading edges 14B1 extend away from the rotation axis RS so that the blade inside diameter IDe increases from the backing plate 11 toward the rim 13. The inclined portion 141B2 is provided beside the backing plate 11 between the backing plate 11 and the rim 13. Accordingly, the leading edge 14B1 of a second blade 12B is formed by an inclined portion 141B2 provided beside the backing plate 11 and an inclined portion 141B provided beside the rim 13. That is, a second blade 12B of the plurality of blades 12 has two inclined portions, namely an inclined portion 141B and an inclined portion 141B2, between the backing plate 11 and the rim 13. A second blade 12B of the plurality of blades 12 is not limited to being configured to have two inclined portions, namely an inclined portion 141B and an inclined portion 141B2, but needs only have two or more inclined portions. The plurality of blades 12 have gradients formed on the inner circumference by the inclined portion 141A, the inclined portion 141A2, the inclined portion 141B, and the inclined portion 141B2.

At least either the inclined portion 141A or the inclined portion 141A2 is inclined relative to the rotation axis RS. The inclined portion 141A and/or the inclined portion 141A2 has/have an angle of inclination preferably larger than 0 degree and smaller than or equal to 60 degrees or more preferably larger than 0 degree and smaller than or equal to 45 degrees. That is, an angle of inclination θ1 between the inclined portion 141A and the rotation axis RS is configured to preferably satisfy the relationship "0 degree<θ1≤60 degrees" or more preferably satisfy the relationship "0 degree<θ1≤45 degrees". Alternatively, an angle of inclination θ11 between the inclined portion 141A2 and the rotation axis RS is configured to preferably satisfy the relationship "0 degree<θ11≤60 degrees" or more preferably satisfy the relationship "0 degree<θ11≤45 degrees". In FIG. 19, the virtual line VL3 is a virtual line parallel with the rotation axis RS. Therefore, an angle between the inclined portion 141A2 and the virtual line VL3 is equal to the angle between the inclined portion 141A2 and the rotation axis RS.

The angle of inclination θ1 of the inclined portion 141A and the angle of inclination θ11 of the inclined portion 141A2 are different angles. In a case in which a first blade 12A has two or more inclined portions, the angle of inclination of each inclined portion is different from that of the other. There is no limit on a relationship between the magnitude of the angle of inclination θ1 of the inclined portion 141A and the magnitude of the angle of inclination θ11 of the inclined portion 141A2. For example, as shown in FIG. 19, the magnitude of the angle of inclination θ11 of the inclined portion 141A2 of a first blade 12A may be greater than the magnitude of the angle of inclination θ1 of the inclined portion 141A of the first blade 12A. Alternatively, the magnitude of the angle of inclination θ11 of the inclined portion 141A2 of a first blade 12A may be smaller than the magnitude of the angle of inclination θ1 of the inclined portion 141A of the first blade 12A.

Similarly, at least either the inclined portion 141B or the inclined portion 141B2 is inclined relative to the rotation axis RS. The inclined portion 141B and/or the inclined portion 141B2 has/have an angle of inclination preferably larger than 0 degree and smaller than or equal to 60 degrees or more preferably larger than 0 degree and smaller than or equal to 45 degrees. That is, an angle of inclination θ2 between the inclined portion 141B and the rotation axis RS is configured to preferably satisfy the relationship "0 degree<θ2≤60 degrees" or more preferably satisfy the relationship "0 degree<θ2≤45 degrees". Alternatively, an angle of inclination θ22 between the inclined portion 141B2 and the rotation axis RS is configured to preferably satisfy the relationship "0 degree<θ22≤60 degrees" or more preferably satisfy the relationship "0 degree<θ22≤45 degrees". In FIG. 19, the virtual line VL4 is a virtual line parallel with the rotation axis RS. Therefore, an angle between the inclined portion 141B2 and the virtual line VL4 is equal to the angle between the inclined portion 141B2 and the rotation axis RS.

The angle of inclination θ2 of the inclined portion 141B and the angle of inclination θ22 of the inclined portion 141B2 are different angles. In a case in which a second blade 12B has two or more inclined portions, the angle of inclination of each inclined portion is different from that of the other. There is no limit on a relationship between the magnitude of the angle of inclination θ2 of the inclined portion 141B and the magnitude of the angle of inclination θ22 of the inclined portion 141B2. For example, as shown in FIG. 19, the magnitude of the angle of inclination θ22 of the inclined portion 141B2 of a second blade 12B may be greater than the magnitude of the angle of inclination θ2 of the inclined portion 141B of the second blade 12B. Alternatively, the magnitude of the angle of inclination θ22 of the inclined portion 141B2 of a second blade 12B may be smaller than the magnitude of the angle of inclination θ2 of the inclined portion 141B of the second blade 12B.

The blade height WH shown in FIG. 19 is less than or equal to 200 mm. The blade height WH is the distance between the backing plate 11 and end portions 12*t* of the plurality of blades 12 in the axial direction of the rotation axis RS, and is the maximum distance between the backing plate 11 and the end portions 12*t* of the plurality of blades 12 in the axial direction of the rotation axis RS. The blade height WH is not limited to being less than or equal to 200 mm but may be greater than 200 mm.

[Working Effects of Impeller 10E and Multi-Blade Air-Sending Device 100E]

As shown in FIG. 19, the multi-blade air-sending device 100E has an inclined portion 141A, an inclined portion 141A2, an inclined portion 141B, and an inclined portion 141B2 at the leading edges of the blades 12, and has a gradient formed in the blade inside diameter IDe. Therefore, the gradient formed in the blade inside diameter IDe of the blades 12 allows the multi-blade air-sending device 100E to ensure a wide area of the leading edges of the blades 12 relative to a flow of gas, so that air can pass through the impeller 10E with low ventilation resistance. As a result, the multi-blade air-sending device 100E can increase air-sending efficiency.

Embodiment 3

[Multi-Blade Air-Sending Device 100F]

Figure 20:
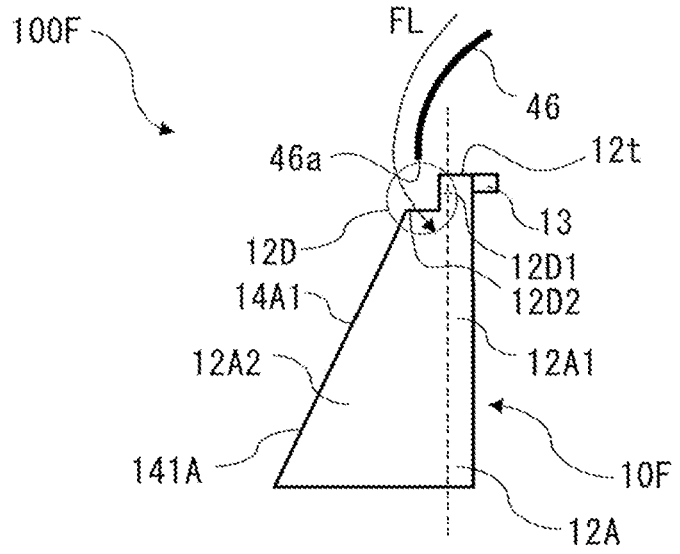
FIG. 20 is a schematic view illustrating a relationship between a bellmouth and a blade of a multi-blade air-sending device according to Embodiment 3.
Figure 21:
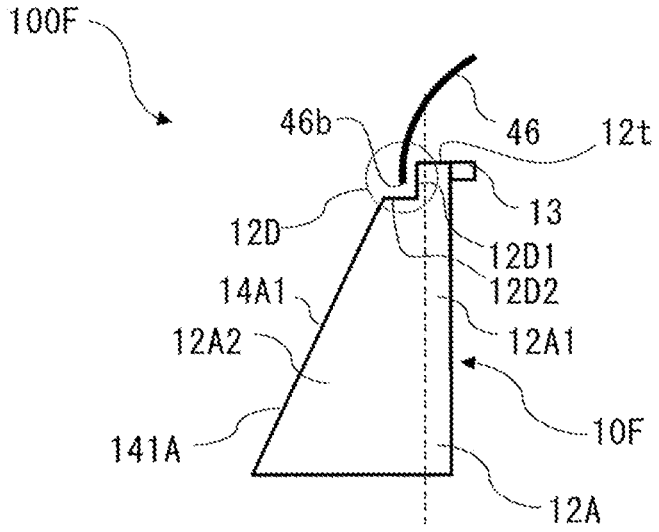
FIG. 21 is a schematic view illustrating a relationship between a bellmouth and a blade of a modification of the multi-blade air-sending device according to Embodiment 3.

FIG. 20 is a schematic view illustrating a relationship between a bellmouth 46 and a blade 12 of a multi-blade air-sending device 100F according to Embodiment 3. FIG. 21 is a schematic view illustrating a relationship between a bellmouth 46 and a blade 12 of a modification of the multi-blade air-sending device 100F according to Embodiment 3. The multi-blade air-sending device 100F according to Embodiment 3 is described with reference to FIGS. 20 and 21. It should be noted that elements having identical configurations as those of the multi-blade air-sending device 100 or other devices of FIGS. 1 to 19 are given identical signs and a description of such elements is omitted. An impeller 10F of the multi-blade air-sending device 100F according to Embodiment 3 is intended to further specify the configuration of the turbo blade portions of the impeller 10 of the multi-blade air-sending device 100 according to Embodiment 1. Accordingly, in the following description, the impeller 10F is described with reference to FIGS. 20 and 21 with a focus on a configuration of the turbo blade portions of the multi-blade air-sending device 100F according to Embodiment 3.

The impeller 10F of the multi-blade air-sending device 100F according to Embodiment 3 has a step portion 12D formed at an end portion 12*t* of a turbo blade portion facing the rim 13. In the following, as shown in FIG. 20, the step portion 12D is described with reference to a first blade 12A. The step portion 12D is formed at an end portion 12*t* of the first turbo blade portion 12A2 facing the rim 13. That is, the step portion 12D is formed at an end portion 12*t* of the inclined portion 141A facing the rim 13. The step portion 12D is a portion in which a wall forming the first blade 12A is formed in a notched state. The step portion 12D is a portion in which a portion of joining between the leading edge 14A1 of the first blade 12A and the end portion 12*t* of the first turbo blade portion 12A2 facing the rim 13 is formed in a notched state. The step portion 12D is formed by a side edge portion 12D1 extending in the axial direction of the rotation axis RS of the impeller 10F and an upper edge portion 12D2 extending in the radial direction of the impeller 10F. Note, however, that the step portion 12D is not limited to being configured to be formed by a side edge portion 12D1 extending in the axial direction of the rotation axis RS of the impeller 10F and an upper edge portion 12D2 extending in the radial direction of the impeller 10F. For example, the step portion 12D may be formed as an arc-shaped edge portion formed by a continuously-integrated combination of a side edge portion 12D1 and an upper edge portion 12D2.

A second blade 12B has a step portion 12D formed therein, too, although the step portion 12D of the second blade 12B is not illustrated, as it is similar in configuration to that of the first blade 12A. The step portion 12D is formed at an end portion 12*t* of the second turbo blade portion 12B2 facing the rim 13, too. That is, the step portion 12D is formed at an end portion 12*t* of the inclined portion 141B facing the rim 13. The step portion 12D is a portion in which a wall forming the second blade 12B is formed in a notched state. The step portion 12D is a portion in which a portion of joining between the leading edge 14B1 of the second blade 12B and the end portion 12*t* of the second turbo blade portion 12B2 facing the rim 13 is formed in a notched state.

The plurality of blades 12 of the multi-blade air-sending device 100F according to Embodiment 3 are formed such that a blade outside diameter formed by the outer circumferential end of each of the plurality of blades 12 is larger than the inside diameter BI of the bellmouth 46. Moreover, as shown in FIGS. 20 and 21, the multi-blade air-sending device 100F is configured such that an inner circumferential end portion 46*b* of the bellmouth 46 is disposed above the step portion 12D. The multi-blade air-sending device 100F is configured such that the inner circumferential end portion 46*b* of the bellmouth 46 is disposed so as to face the upper edge portion 12D2 of the step portion 12D. The multi-blade air-sending device 100F has a gap formed between the inner circumferential end portion 46*b* of the bellmouth 46 and the side edge portion 12D1 and between the inner circumferential end portion 46*b* of the bellmouth 46 and the upper edge portion 12D2.

[Working Effects of Impeller 10F and Multi-Blade Air-Sending Device 100F]

The impeller 10F and the multi-blade air-sending device 100F have a step portion formed at an end portion 12*t* of a turbo blade portion facing the rim 13. The step portion 12D allows the impeller 10F and the multi-blade air-sending device 100F to widen the gap between a bellmouth 46 and a blade 12. Therefore, the impeller 10F and the multi-blade air-sending device 100F can suppress an increase in velocity of a flow of gas in the gap between the bellmouth 46 and the blade 12, thus making it possible to reduce noise generated by the flow of gas passing through the gap between the bellmouth 46 and the blade 12.

Further, the impeller 10F and the multi-blade air-sending device 100F allow the bellmouth 46 to be brought closer to the impeller 10F than in a case in which a blade 12 has no step portion 12D. Moreover, the impeller 10F and the multi-blade air-sending device 100F can reduce the gap between the bellmouth 46 and the blade 12 by bringing the bellmouth 46 close to the impeller 10F. As a result, the impeller 10F and the multi-blade air-sending device 100F can reduce leakage of suctioned air, that is, the amount of air that does not pass through the space between adjacent blades 12 of the impeller 10F. Since the bellmouth 46 and the side edge portion 12D1 are disposed so as to face each other as shown in FIG. 21, the impeller 10F and the multi-blade air-sending device 100F can further reduce leakage of suctioned air than in a case in which the bellmouth 46 and the side edge portion 12D1 do not face each other. In other words, since the bellmouth 46 is disposed within the step portion 12D and disposed above and in the radial direction of the blade 12, the multi-blade air-sending device 100F can further reduce leakage of suctioned air than in a case in which the bellmouth 46 is not disposed within the step portion 12D.

Embodiment 4

[Multi-Blade Air-Sending Device 100G]

Figure 22:
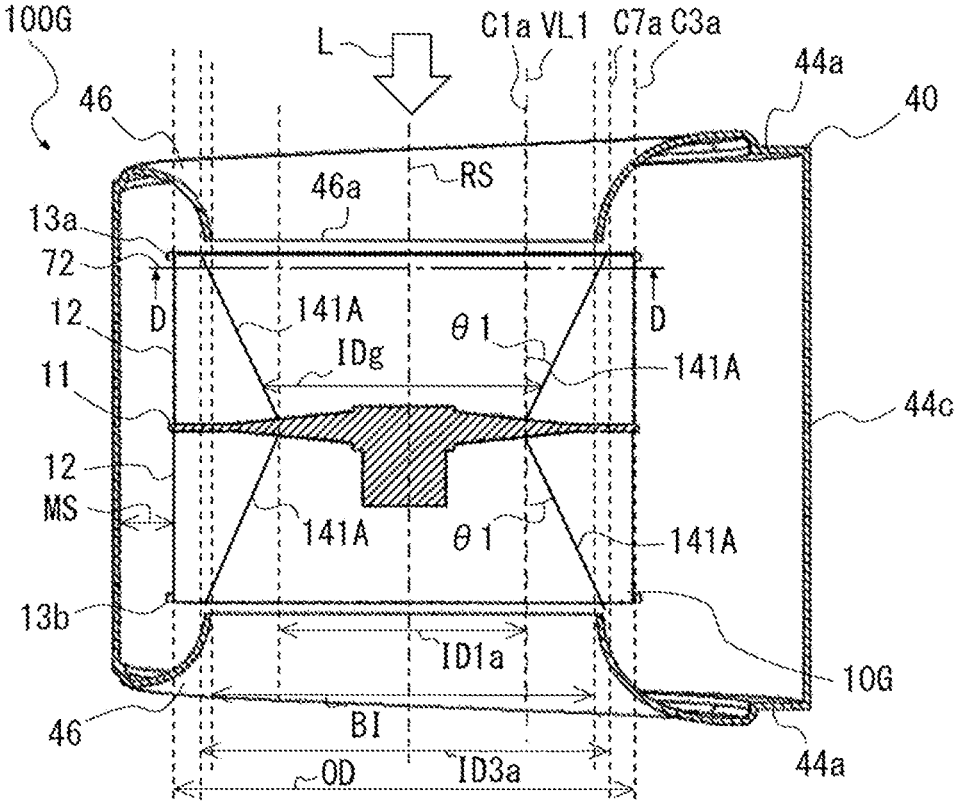
FIG. 22 is a cross-sectional view schematically illustrating a multi-blade air-sending device according to Embodiment 4.
Figure 23:
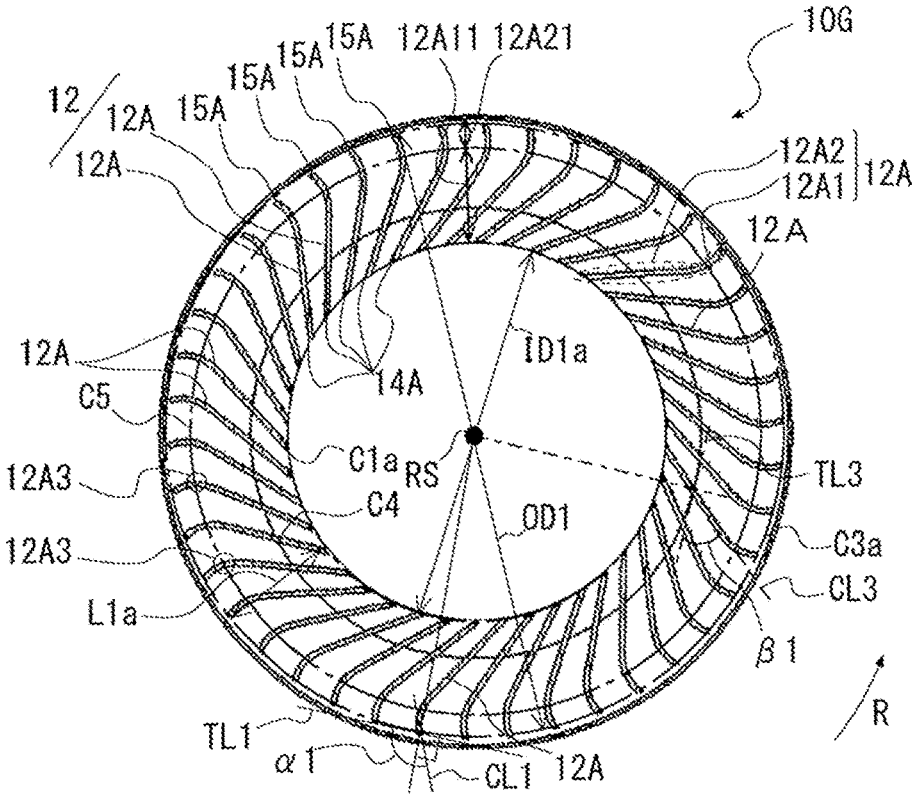
FIG. 23 is a schematic view of blades as viewed from an angle parallel with a rotation axis in an impeller of FIG. 22.
Figure 24:
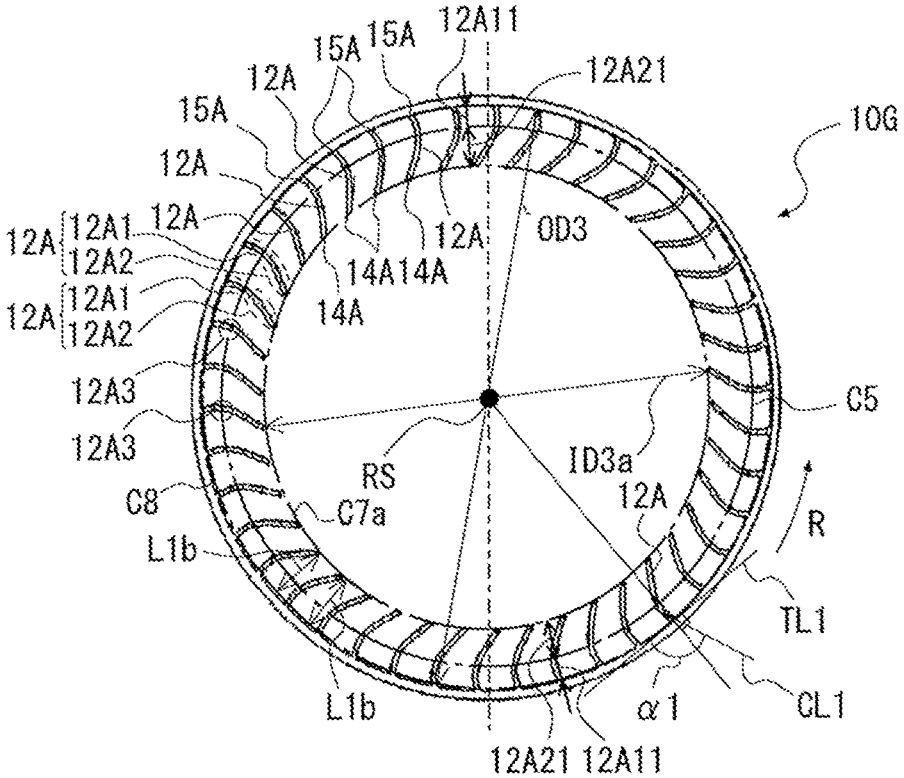
FIG. 24 is a schematic view of the blades in a cross-section of the impeller as taken along line D-D in FIG. 22.

FIG. 22 is a cross-sectional view schematically illustrating a multi-blade air-sending device 100G according to Embodiment 4. FIG. 23 is a schematic view of blades 12 as viewed from an angle parallel with a rotation axis RS in an impeller 10G of FIG. 22. FIG. 24 is a schematic view of the blades 12 in a cross-section of the impeller 10G as taken along line D-D in FIG. 22. The multi-blade air-sending device 100G according to Embodiment 4 is described with reference to FIGS. 22 to 24. It should be noted that elements having identical configurations as those of the multi-blade air-sending device 100 or other devices of FIGS. 1 to 21 are given identical signs and a description of such elements is omitted.

As shown in FIGS. 22 to 24, the impeller 10G of the multi-blade air-sending device 100G according to Embodiment 4 is configured such that all of the plurality of blades 12 are formed by first blades 12A. As shown in FIGS. 22 to 24, the impeller 10G has forty-two first blades 12A disposed therein. However, the number of first blades 12A is not limited to 42 but may be smaller or larger than 42.

Each of the first blades 12A has the relationship "Blade Length L1*a*>Blade Length L1*b*". That is, each of the first blades 12A is formed such that its blade length decreases from the backing plate 11 toward the rim 13 in the axial direction of the rotation axis RS. Moreover, as shown in FIG. 22, each of the first blades 12A is inclined such that a blade inside diameter IDg increases from the backing plate 11 toward the rim 13. That is, the plurality of blades 12 form an inclined portion 141A inclined such that the inner circumferential ends 14A forming the leading edges 14A1 extend away from the rotation axis RS so that the blade inside diameter IDg increases from the backing plate 11 toward the rim 13.

Each of the first blades 12A has a first sirocco blade portion 12A1 being forward-swept and a first turbo blade portion 12A2 being swept-back. Each of the first blades 12A is configured such that the first turbo region 12A21 is larger than the first sirocco region 12A11 in the radial direction of the impeller 10. That is, the impeller 10 and each of the first blades 12A are configured such that in both the backing-plate-side blade region 122*a* serving as the first region and the rim-side blade region 122*b* serving as the second region, a ratio of the first turbo blade portion 12A2 is larger than a ratio of the first sirocco blade portion 12A1 in the radial direction of the impeller 10.

When a spacing between two of the plurality of blades 12 adjacent to each other in the circumferential direction is defined as a blade spacing, the blade spacing between a plurality of blades 12 widens from the leading edges 14A1 toward the trailing edges 15A1 as shown in FIGS. 23 and 24. Specifically, a blade spacing in the first turbo blade portion 12A2 widens from the inner circumference toward the outer circumference. Moreover, a blade spacing in a first sirocco blade portion 12A1 is wider than the blade spacing in the first turbo blade portion 12A2 and widens from the inner circumference toward the outer circumference.

As shown in FIG. 22, the inside diameter BI of the bellmouth 46 is larger than the inside diameter ID1*a* of the first blades 12A beside the backing plate 11 and smaller than the inside diameter ID3*a* of the first blades 12A beside the rim 13. That is, the inside diameter BI of the bellmouth 46 is to be larger than the blade inside diameter IDg of the plurality of blades 12 beside the backing plate 11 and smaller than the blade inside diameter IDg of the plurality of blades 12 beside the rim 13.

[Working Effects of Impeller 10G and Multi-Blade Air-Sending Device 100G]

The impeller 10G and the multi-blade air-sending device 100G can bring about effects similar to those of the multi-blade air-sending device 100 and the impeller 10 according to Embodiment 1. For example, the impeller 10G and the multi-blade air-sending device 100G are configured such that in any region between the backing plate 11 and the rim 13, a ratio of a region of the first turbo blade portion 12A2 in the radial direction of the backing plate 11 is larger than a ratio of a region of the first sirocco blade portion 12A1 in the radial direction of the backing plate 11. Since the impeller 10G and the multi-blade air-sending device 100G are configured such that the ratio of the turbo blade portion is high in any region between the backing plate 11 and the rim 13, sufficient pressure recovery can be achieved through the plurality of blades 12. Therefore, the impeller 10G and the multi-blade air-sending device 100G can better improve pressure recovery than an impeller or a multi-blade air-sending device that does not include such a configuration. As a result, the impeller 10G can improve the efficiency of the multi-blade air-sending device 100G. Furthermore, by including the foregoing configuration, the impeller 10G can reduce leading edge separation of a flow of gas beside the rim 13.

Embodiments 1 to 4 have been described by taking as an example a multi-blade air-sending device 100 including a double-suction impeller 10 having a plurality of blades 12 formed on both sides of a backing plate 11. However, Embodiments 1 to 4 are also applicable to a multi-blade air-sending device 100 including a single-suction impeller 10 having a plurality of blades 12 formed only on one side of a backing plate 11.

Embodiment 5

[Air-Conditioning Apparatus 140]

Figure 25:
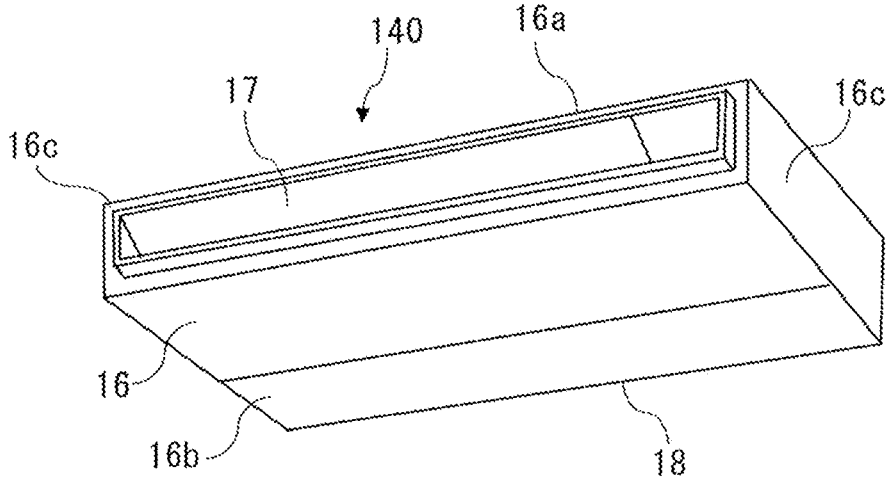
FIG. 25 is a perspective view of an air-conditioning apparatus according to Embodiment 5.
Figure 26:
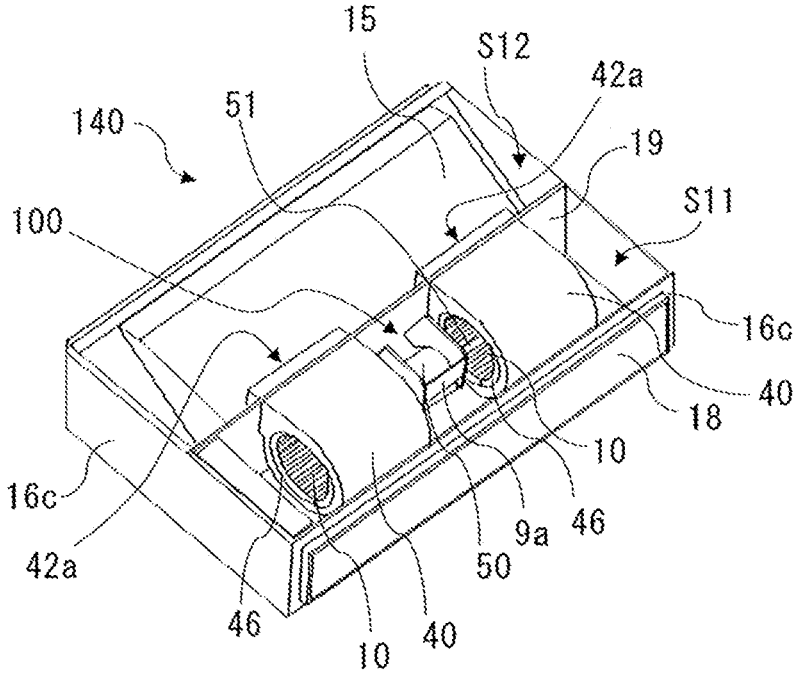
FIG. 26 is a diagram illustrating an internal configuration of the air-conditioning apparatus according to Embodiment 5.

FIG. 25 is a perspective view of an air-conditioning apparatus 140 according to Embodiment 5. FIG. 26 is a diagram illustrating an internal configuration of the air-conditioning apparatus 140 according to Embodiment 5. As for a multi-blade air-sending device 100 used in the air-conditioning apparatus 140 according to Embodiment 5, elements having identical configurations as those of the multi-blade air-sending device 100 or other devices of FIGS. 1 to 24 are given identical signs, and a description of such elements is omitted. To show the internal configuration of the air-conditioning apparatus 140, FIG. 26 omits to illustrate an upper surface portion 16*a*.

The air-conditioning apparatus 140 according to Embodiment 5 includes any one or more of the multi-blade air-sending devices 100 to 100G according to Embodiments 1 to 4 and a heat exchanger 15 disposed in such a location as to face a discharge port 42*a* of the multi-blade air-sending device 100. Further, the air-conditioning apparatus 140 according to Embodiment 5 includes a case 16 installed above a ceiling of a room to be air-conditioned. In the following description, the term "multi-blade air-sending device 100" indicates the use of any one of the multi-blade air-sending devices 100 to 100G according to Embodiments 1 to 4. Further, although, in FIGS. 26 and 25, a multi-blade air-sending device 100 having a scroll casing 40 in the case 16 is shown, impellers 10 to 10G or other devices having no scroll casing 40 may be installed in the case 16.

(Case 16)

As shown in FIG. 25, the case 16 is formed in a cuboidal shape including an upper surface portion 16*a*, a lower surface portion 16*b*, and side surface portions 16*c*. The shape of the case 16 is not limited to the cuboidal shape but may for example be another shape such as a columnar shape, a prismatic shape, a conical shape, a shape having a plurality of corner portions, or a shape having a plurality of curved surface portions. One of the side surface portions 16*c* of the case 16 is a side surface portion 16*c* having a case discharge portion 17 formed therein. The case discharge portion 17 is formed in a rectangular shape as shown in FIG. 25. The shape of the case discharge port 17 is not limited to the rectangular shape but may for example be another shape such as a circular shape or an oval shape. Another one of the side surface portions 16*c* of the case 16 is a side surface portion 16*c* having a case air inlet 18 formed therein and being opposite the side surface portion 16*c* having the case discharge port 17 formed therein. The case air inlet 18 is formed in a rectangular shape as shown in FIG. 26. The shape of the case air inlet 18 is not limited to the rectangular shape but may for example be another shape such as a circular shape or an oval shape. A filter configured to remove dust in the air may be disposed at the case air inlet 18.

Inside the case 16, the multi-blade air-sending device 100 and the heat exchanger 15 are housed. The multi-blade air-sending device 100 includes an impeller 10, a scroll casing 40 having a bellmouth 46 formed therein, and a motor 50. The motor 50 is supported by a motor support 9*a* fixed to the upper surface portion 16*a* of the case 16. The motor 50 has a motor shaft 51. The motor shaft 51 is disposed so as to extend parallel to the side surface portion 16*c* having the case air inlet 18 formed therein and the side surface portion 16*c* having the case discharge port 17 formed therein. As shown in FIG. 26, the air-conditioning apparatus 140 has two impellers 10 attached to the motor shaft 51. The impellers 10 of the multi-blade air-sending device 100 forms a flow of air that is suctioned into the case 16 through the case air inlet 18 and blown out into an air-conditioned space through the case discharge port 17. The number of impellers 10 that are disposed in the case 16 is not limited to 2 but may be 1 or larger than or equal to 3.

As shown in FIG. 26, the multi-blade air-sending device 100 is attached to a divider 19 configured to divide an internal space of the case 16 into a space S11 facing a suction side of the scroll casing 40 and a space S12 facing a blowout side of the scroll casing 40.

The heat exchanger 15 is disposed in such a location as to face the discharge port 42*a* of the multi-blade air-sending device 100, and is disposed in the case 16 so as to be on an air trunk of air to be discharged by the multi-blade air-sending device 100. The heat exchanger 15 adjusts the temperature of air that is suctioned into the case 16 through the case air inlet 18 and blown out into the air-conditioned space through the case discharge port 17. As the heat exchanger 15, a heat exchanger of a publicly-known structure can be applied. The case air inlet 18 needs only be formed in a location perpendicular to the axial direction of the rotation axis RS of the multi-blade air-sending device 100. For example, the case air inlet 18 may be formed in the lower surface portion 16*b*.

Rotation of the impeller 10 of the multi-blade air-sending device 100 causes the air in the air-conditioned space to be suctioned into the case 16 through the case air inlet 18. The air suctioned into the case 16 is guided toward the bellmouth 46 and suctioned into the impeller 10. The air suctioned into the impeller 10 is blown out outward in the radial direction of the impeller 10. The air blown out from the impeller 10 passes through the inside of the scroll casing 40, blown out of the scroll casing 40 through the discharge port 42*a*, and then supplied to the heat exchanger 15. The air supplied to the heat exchanger 15 is subjected to temperature and humidity control by, during passage through the heat exchanger 15, exchanging heat with refrigerant flowing through the inside of the heat exchanger 15. The air having passed through the heat exchanger 15 is blown out to the air-conditioned space through the case discharge port 17.

The air-conditioning apparatus 140 according to Embodiment 5 includes any one of the multi-blade air-sending devices 100 to 100G according to Embodiments 1 to 4. Therefore, the air-conditioning apparatus 140 can bring about effects similar to those of any of Embodiments 1 to 4.

Each of Embodiment 1 to 5 may be implemented in combination with the other. Further, the configurations shown in the foregoing embodiments show examples and may be combined with another publicly-known technology, and parts of the configurations may be omitted or changed, provided such omissions and changes do not depart from the scope. For example, an embodiment describes an impeller 10 or other devices formed by the backing-plate-side blade region 122*a* serving as the first region and the rim-side blade region 122*b* serving as the second region. The impeller 10 is not limited to an impeller formed solely by the first region and the second region. The impeller 10 may further have another region as well as the first region and the second region. For example, although, in Embodiment 1, each of the blades are shaped such that the blade length continuously changes from the backing plate 11 toward the rim 13, each of the blades may have, in some part between the backing plate 11 and the rim 13, a portion in which the blade length is constant, that is, a portion in which the inside diameter ID is constant and that is not inclined relative to the rotation axis RS.

REFERENCE SIGNS LIST

9*a*: motor support, 10: impeller, 10C: impeller, 10D: impeller, 10E: impeller, 10F: impeller, 10G: impeller, 10H: impeller, 10*e*: air inlet, 11: backing plate, 11*b*: shaft portion, 12: blade, 12A: first blade, 12A1: first sirocco blade portion, 12A11: first sirocco region, 12A2: first turbo blade portion, 12A21: first turbo region, 12A21*a*: first turbo region, 12A2*a*: first turbo blade portion, 12A3: first radial blade portion, 12B: second blade, 12B1: second sirocco blade portion, 12B11: second sirocco region, 12B2: second turbo blade portion, 12B21: second turbo region, 12B21*a*: second turbo region, 12B2*a*: second turbo blade portion, 12B3: second radial blade portion, 12D: step portion, 12D1: side edge portion, 12D2: upper edge portion, 12R: outer circumferential region, 12*t*: end portion, 13: rim, 13*a*: first rim, 13*b*: second rim, 14A: inner circumferential end, 14A1: leading edge, 14B: inner circumferential end, 14B1: leading edge, 14H: leading edge, 15: heat exchanger, 15A: outer circumferential end, 15A1: trailing edge, 15B: outer circumferential end, 15B1: trailing edge, 16: case, 16*a*: upper surface portion, 16*b*: lower surface portion, 16*c*: side surface portion, 17: case discharge port, 18: case air inlet, 19: divider, 40: scroll casing, 41: scroll portion, 41*a*: scroll start portion, 41*b*: scroll end portion, 42: discharge portion, 42*a*: discharge port, 42*b*: extension plate, 42*c*: diffuser plate, 42*d*: first side plate portion, 42*e*: second side plate portion, 43: tongue, 44*a*: side wall, 44*a*1: first side wall, 44*a*2: second side wall, 44*c*: peripheral wall, 45: air inlet, 45*a*: first air inlet, 45*b*: second air inlet, 46: bellmouth, 46*a*: opening, 46*b*: inner peripheral end portion, 50: motor, 50A: motor, 50B: motor, 50*a*: end portion, 51: motor shaft, 52: outer peripheral wall, 52*a*: outer peripheral wall, 52*b*: outer peripheral wall, 71: first plane, 72: second plane, 100: multi-blade air-sending device, 100A: multi-blade air-sending device, 100B: multi-blade air-sending device, 100C: multi-blade air-sending device, 100D: multi-blade air-sending device, 100E: multi-blade air-sending device, 100F: multi-blade air-sending device, 100G: multi-blade air-sending device, 100H: multi-blade air-sending device, 112*a*: first blade portion, 112*b*: second blade portion, 122*a*: backing-plate-side blade region, 122*b*: rim-side blade region, 140: air-conditioning apparatus, 141A: inclined portion, 141A2: inclined portion, 141B: inclined portion, 141B2: inclined portion, 141C1: linear portion, 141C2: linear portion

The invention claimed is:

1. A multi-blade air-sending device comprising:

an impeller comprising a backing plate configured to be driven by rotating, an annular rim disposed so as to face the backing plate, and a plurality of blades arranged in a circumferential direction around a virtual rotation axis of the backing plate, one end of each of the plurality of blades being connected with the backing plate, an other end of each of the plurality of blades being connected with the rim; and a scroll casing housing the impeller and having a peripheral wall formed into a volute shape and a side wall having a bellmouth forming an air inlet communicating with a space formed by the backing plate and the plurality of blades, each of the plurality of blades having an inner circumferential end located closer to the rotation axis in a radial direction around the rotation axis, an outer circumferential end located closer to an outer circumference than the inner circumferential end in the radial direction, a sirocco blade portion being forward-swept and including the outer circumferential end and having a blade outlet angle of larger than 90 degrees, and a turbo blade portion being swept-back and including the inner circumferential end, a first region located closer to the backing plate than a middle point in an axial direction of the rotation axis; and a second region located closer to the rim than the first region, the plurality of blades being formed such that a blade length, decreases from the backing plate toward the rim, a ratio of the turbo blade portion in the radial direction to a total length of a corresponding blade in the radial direction being larger than a ratio of the sirocco blade portion in the radial direction to the total length of the corresponding blade in the radial direction, wherein an inside diameter of the bellmouth is smaller than a blade inside diameter formed by the inner circumferential end of each of the plurality of blades in the second region.

2. The multi-blade air-sending device of claim 1, wherein each of the plurality of blades has an inclined portion inclined such that the inner circumferential end extends away from the rotation axis from the backing plate toward the rim.

3. The multi-blade air-sending device of claim 2, wherein the inclined portion is inclined at an angle of larger than 0 degree and smaller than or equal to 60 degrees relative to the rotation axis.

4. The multi-blade air-sending device of claim 1, wherein a ratio of a blade inside diameter formed by the inner circumferential end of each of the plurality of blades to a blade outside diameter formed by the outer circumferential end of each of the plurality of blades is lower than or equal to 0.7.

5. The multi-blade air-sending device of claim 1, wherein when a spacing between two of the plurality of blades adjacent to each other in the circumferential direction is defined as a blade spacing, a blade spacing of the turbo blade portion widens from an inner circumference toward the outer circumference in the radial direction, and a blade spacing of the sirocco blade portion is wider than the blade spacing of the turbo blade portion and widens from the inner circumference toward the outer circumference in the radial direction.

6. The multi-blade air-sending device of claim 1, herein the turbo blade portion linearly extends from the inner circumferential end toward the outer circumference in the radial direction.

7. The multi-blade air-sending device of claim 1, wherein each of the plurality of blades has a radial blade portion serving as a portion of connection between the turbo blade portion and the sirocco blade portion and having a blade angle of 90 degrees.

8. The multi-blade air-sending device of claim 1, wherein the plurality of blades include a plurality of first blades and a plurality of second blades, in a first cross-section of the plurality of blades as taken along a first plane perpendicular to the rotation axis in the first region, each of the plurality of first blades has a blade length longer than a blade length of each of the plurality of second blades, and at least one of the plurality of second blades is disposed between two of the plurality of first blades adjacent to each other in the circumferential direction.

9. The impeller multi-blade air-sending device of claim 8, wherein the plurality of second blades are configured such that a ratio of an inside diameter formed by the inner circumferential end of each of the plurality of second blades to an outside diameter formed by the outer circumferential end of each of the plurality of second blades is lower than or equal to 0.7.

10. The multi-blade air-sending device of claim 1, wherein the plurality of blades are formed such that a blade outside diameter formed by the outer circumferential end of each of the plurality of blades is larger than an inside diameter of the bellmouth, and in a portion of the plurality of blades situated closer to the outer circumference than the inside diameter of the bellmouth in the radial direction, a ratio of the turbo blade portion in the radial direction is larger than a ratio of the sirocco blade portion in the radial direction in both the first region and the second region.

11. The multi-blade air-sending device of claim 1, wherein the plurality of blades are formed such that a blade outside diameter formed by the outer circumferential end of each of the plurality of blades is larger than an inside diameter of the bellmouth, and each of the plurality of blades has a step portion formed at an end portion of the turbo blade portion facing the rim.

12. The multi-blade air-sending device of claim 1, wherein an inside diameter of the bellmouth is formed to be larger than a blade inside diameter formed by the inner circumferential end of each of the plurality of blades in the first region.

13. The multi-blade air-sending device of claim 1, wherein a shortest distance between the plurality of blades and the peripheral wall is more than twice as long as a radial length of the sirocco blade portion.

14. The multi-blade air-sending device of claim 1, further comprising a motor having a motor shaft connected to the backing plate and being disposed outside the scroll casing, an outside diameter of the motor is formed to be larger than a blade inside diameter of the plurality of blades beside the backing plate and smaller than a blade inside diameter of the plurality of blades beside the rim.

15. The multi-blade air-sending device of claim 1, further comprising a motor having a motor shaft connected to the backing plate and being disposed outside the scroll casing, an outside diameter of an end portion of the motor is formed to be larger than a blade inside diameter of the plurality of blades beside the backing plate and smaller than a blade inside diameter of the plurality of blades beside the rim.

16. An air-conditioning apparatus comprising the multi-blade air-sending device of claim 1.

17. The multi-blade air-sending device of any one of claim 1, wherein each of the blades has, in some part between the backing plate and the rim, a portion in which the blade length is constant.

18. The multi-blade air-sending device of claim 1, wherein each of the blades are shaped such that the blade length continuously changes from the backing plate toward the rim.

* * * * *